US011268791B1

(12) United States Patent
Frees et al.

(10) Patent No.: US 11,268,791 B1
(45) Date of Patent: Mar. 8, 2022

(54) HANDGUN CARTRIDGE WITH SHEAR GROOVE BULLET

(71) Applicant: Vista Outdoor Operations LLC, Anoka, MN (US)

(72) Inventors: Frederick Frees, Lewiston, ID (US); Richard D. Hurt, Clear Lake, MN (US); David M. Laska, Andover, MN (US); Lawrence P. Head, Cambridge, MN (US); Shawn D. Fitzsimonds, St. Francis, MN (US)

(73) Assignee: Vista Outdoor Operations LLC, Anoka, MN (US)

( * ) Notice: Subject to any disclaimer, the term of this patent is extended or adjusted under 35 U.S.C. 154(b) by 283 days.

(21) Appl. No.: 16/509,394

(22) Filed: Jul. 11, 2019

Related U.S. Application Data

(63) Continuation-in-part of application No. 14/722,076, filed on May 26, 2015, now abandoned.

(60) Provisional application No. 62/696,804, filed on Jul. 11, 2018, provisional application No. 62/002,600, filed on May 23, 2014.

(51) Int. Cl.
*F42B 5/28* (2006.01)
*F42B 12/02* (2006.01)
*F42B 12/78* (2006.01)

(52) U.S. Cl.
CPC ..... *F42B 5/28* (2013.01); *F42B 12/02* (2013.01); *F42B 12/78* (2013.01)

(58) Field of Classification Search
CPC ..... F42B 5/28; F42B 12/02; F42B 12/78
See application file for complete search history.

(56) References Cited

U.S. PATENT DOCUMENTS

| | | | |
|---|---|---|---|
| 326,231 | A | 9/1885 | Manning |
| 682,600 | A | 9/1901 | Butler |
| 694,675 | A | 3/1902 | Scott |
| 1,059,213 | A | 4/1913 | Ross |
| 1,077,564 | A | 11/1913 | Starkweather |
| 1,077,607 | A | 11/1913 | Johnson |

(Continued)

FOREIGN PATENT DOCUMENTS

| | | |
|---|---|---|
| DE | 3 822775 A1 | 2/1990 |
| EP | 0 129 608 | 1/1985 |

(Continued)

OTHER PUBLICATIONS

Academy Sports & Outdoors, Reloading Bullets Product listing, accessed online Jan. 7, 2014, at: http://www.academy.com/shop/browse/hungting-reloading-reloading-components-reloading-bullets (5 pgs.).

(Continued)

*Primary Examiner* — Michelle Clement
(74) *Attorney, Agent, or Firm* — Reed Smith LLP; Matthew P. Frederick; John M. Cogill

(57) ABSTRACT

A rimless cartridge comprising a case and a bullet mounted therein. In embodiments, the bullet comprises a jacket having a cylindrical body portion, an ogive portion, and a plurality of longitudinally extending paths of weakness formed in the ogive portion and defining petals there between and extending rearward from the mouth. The bullet includes a malleable core mounted within the jacket. The bullet further comprises a circumferential groove between forward and rearward circumferential indentations imparted in the body portion of the jacket.

18 Claims, 9 Drawing Sheets

(56) References Cited

U.S. PATENT DOCUMENTS

| | | | |
|---|---|---|---|
| 1,080,976 | A | 12/1913 | Johnson |
| 1,081,616 | A | 12/1913 | Johnson |
| 1,095,501 | A | 5/1914 | Hoagland |
| 1,099,298 | A | 6/1914 | Hoagland |
| 1,135,357 | A | 4/1915 | Clyne |
| 1,556,160 | A | 10/1925 | Riggs |
| 1,681,295 | A | 8/1928 | Johnson |
| 1,715,788 | A | 6/1929 | Rousseau |
| 1,730,871 | A | 10/1929 | Aronson |
| 1,833,127 | A | 11/1931 | Rinkel |
| 2,045,964 | A | 6/1936 | Rinkel |
| 2,110,264 | A | 3/1938 | Gerlich |
| 2,123,981 | A | 7/1938 | Whipple |
| 2,321,344 | A | 6/1943 | Whipple |
| 2,327,950 | A | 8/1943 | Whipple |
| 2,333,091 | A | 11/1943 | Crasnoff |
| 2,616,371 | A | 11/1952 | Catlin |
| 2,683,416 | A | 7/1954 | Keller et al. |
| 2,765,738 | A | 10/1956 | Freeh, Jr. |
| 2,792,618 | A | 5/1957 | Walker |
| 2,798,431 | A | 7/1957 | Semon et al. |
| 2,838,000 | A | 6/1958 | Schreiber |
| 2,898,666 | A | 8/1959 | Frost |
| 3,003,420 | A | 10/1961 | Nosier |
| 3,142,256 | A | 7/1964 | Mack |
| 3,143,966 | A | 8/1964 | Burns, Jr. et al. |
| 3,157,137 | A | 11/1964 | Burns, Jr. |
| 3,165,809 | A | 1/1965 | Burns, Jr. et al. |
| 3,311,962 | A | 4/1967 | Burns, Jr. |
| 3,349,711 | A | 10/1967 | Darigo et al. |
| 3,426,685 | A | 2/1969 | Stubbs |
| 4,044,685 | A | 8/1977 | Avcin |
| 4,193,348 | A | 3/1980 | Halverson |
| 4,245,557 | A | 1/1981 | Knappworst et al. |
| 4,336,756 | A | 6/1982 | Schreiber |
| 4,352,225 | A | 10/1982 | Schreiber |
| 4,550,662 | A | 11/1985 | Burczynski |
| 4,610,061 | A | 9/1986 | Halverson |
| 4,644,866 | A | 2/1987 | Sullivan |
| 4,655,140 | A | 4/1987 | Schimeker |
| 4,776,279 | A | 10/1988 | Pejsa |
| 4,836,110 | A | 6/1989 | Burczynski |
| 4,856,160 | A | 8/1989 | Habbe et al. |
| 4,878,434 | A | 11/1989 | Sommet |
| 4,882,822 | A | 11/1989 | Burczynski |
| 4,947,755 | A | 8/1990 | Burczynski |
| 5,079,814 | A | 1/1992 | Moore et al. |
| 5,101,732 | A | 4/1992 | Schluckebier |
| 5,127,332 | A | 7/1992 | Corzine et al. |
| 5,131,123 | A | 7/1992 | Brooks |
| 5,187,325 | A | 2/1993 | Garvison |
| 5,200,573 | A | 4/1993 | Blood |
| 5,208,424 | A | 5/1993 | Schluckebier et al. |
| 5,259,320 | A | 11/1993 | Brooks |
| 5,275,108 | A | 1/1994 | Chernicky et al. |
| 5,357,866 | A | 10/1994 | Schluckebier et al. |
| 5,385,100 | A | 1/1995 | Corzine et al. |
| 5,528,990 | A | 6/1996 | Corzine et al. |
| 5,544,398 | A | 8/1996 | Corzine et al. |
| 5,641,937 | A | 6/1997 | Carter |
| 5,686,693 | A | 11/1997 | Jakobsson |
| 5,811,723 | A | 9/1998 | Stone |
| 5,943,749 | A | 8/1999 | Swank |
| 6,178,890 | B1 | 1/2001 | Burczynski |
| 6,182,574 | B1 | 2/2001 | Giannoni |
| 6,244,187 | B1 | 6/2001 | Head |
| 6,257,149 | B1 | 7/2001 | Cesaroni |
| 6,305,292 | B1 | 10/2001 | Burczynski et al. |
| 6,314,670 | B1 | 11/2001 | Rodney, Jr. |
| 6,439,125 | B1 | 8/2002 | Carter |
| 6,530,328 | B2 | 3/2003 | Burczynski et al. |
| 6,732,657 | B2 | 5/2004 | Olin |
| 6,776,101 | B1 | 8/2004 | Pickard |
| 6,805,057 | B2 | 10/2004 | Carr et al. |
| 6,837,165 | B2 | 1/2005 | Eberhart et al. |
| 6,935,243 | B2 | 8/2005 | Dippold |
| 6,973,879 | B1 | 12/2005 | McElroy et al. |
| 7,127,996 | B2 | 10/2006 | Muth |
| 7,143,679 | B2 | 12/2006 | Yaich |
| 7,162,942 | B2 | 1/2007 | Dippold |
| 7,207,275 | B1 | 4/2007 | Oertwig |
| 7,311,046 | B2 | 12/2007 | Riess et al. |
| 7,380,502 | B2 | 6/2008 | Emary |
| 7,543,535 | B2 | 6/2009 | Herrlinger |
| 7,814,837 | B2 | 10/2010 | Sauvestre |
| 8,087,359 | B2 | 1/2012 | Sauvestre |
| 8,141,494 | B2 | 3/2012 | Riess et al. |
| 8,256,352 | B2 | 9/2012 | Masinelli |
| 8,276,494 | B2 | 10/2012 | Palkowitsh |
| 8,413,587 | B2 | 4/2013 | Emary |
| 8,646,389 | B2 | 2/2014 | Masinelli |
| 8,857,343 | B2 | 10/2014 | Marx |
| 8,950,333 | B2 | 2/2015 | Burczynski et al. |
| D733,834 | S | 7/2015 | Burczynski et al. |
| D735,289 | S | 7/2015 | Burczynski et al. |
| 9,121,677 | B2 | 9/2015 | Emary |
| 9,188,414 | B2 | 11/2015 | Burczynski |
| 9,254,503 | B2 | 2/2016 | Ward |
| 9,366,512 | B2 | 6/2016 | Burczynski |
| 9,383,178 | B2 | 7/2016 | Powers, Jr. |
| 9,404,719 | B1 | 8/2016 | Bowers |
| 9,702,677 | B2 | 7/2017 | Balzano |
| 9,885,552 | B2 | 2/2018 | Krause |
| 2003/0005846 | A1 | 1/2003 | Atwood |
| 2004/0050284 | A1 | 3/2004 | Piela |
| 2005/0183617 | A1 | 8/2005 | MacDougall |
| 2008/0035008 | A1 | 2/2008 | Riess et al. |
| 2008/0216700 | A1 | 9/2008 | Martini Filho |
| 2009/0293754 | A1 | 12/2009 | Riess et al. |
| 2010/0018430 | A1 | 1/2010 | Masinelli et al. |
| 2010/0224093 | A1 | 9/2010 | Wilhelm et al. |
| 2011/0083546 | A1 | 4/2011 | Palkowitsh |
| 2011/0203477 | A1 | 8/2011 | Amick |
| 2013/0025490 | A1 | 1/2013 | Burczynski |
| 2013/0092042 | A1 | 4/2013 | Masinelli |
| 2014/0130699 | A1 | 5/2014 | Peterson et al. |
| 2014/0230683 | A1 | 8/2014 | Burczynski |
| 2015/0083011 | A1 | 3/2015 | Emary |
| 2015/0308799 | A1 | 10/2015 | Powers, Jr. |
| 2015/0330756 | A1 | 11/2015 | Ward |
| 2016/0025469 | A1 | 1/2016 | Nurminen |

FOREIGN PATENT DOCUMENTS

| | | |
|---|---|---|
| EP | O 150 229 | 8/1985 |
| EP | 1 381 822 | 1/2004 |
| EP | 2 551 630 A2 | 1/2013 |
| FR | 1255993 | 3/1961 |
| FR | 2431111 A1 | 2/1980 |
| GB | 1038702 | 8/1966 |
| RU | 2180427 | 3/2002 |
| RU | 2240487 C2 | 11/2004 |
| WO | WO 02/086414 | 10/2002 |
| WO | WO 2013/086544 A2 | 6/2013 |

OTHER PUBLICATIONS

Hornady FlexLock Critical Duty product description, accessed online Jan. 7, 2014, at: http://www.hornady.com/store/9mm-135-gr-FlexLock-Critical-Duty/ (5 pgs.).

Hornady FTX®.44/.444 Marlin 265-Grain Rifle Bullets product description, accessed online Jan. 2014 at: http://www.academy.com/shop/browse/_/N-0/Ntt—hornady&Ntk=All&Ntx=mode+matchallpartial (2 pgs.).

Hornady FTX®.45 325-Grain Bullets product description, accessed online Jan. 2014 at: htip://www.academv.com/shop/browse/_/N-0?Ntt—hornady&Ntk-All&Nt-mode+matchallpartial (2 pgs.).

Hornady GMX®.30 Caliber 150-Grain Bullets product description, accessed online Jan. 7, 2014, at: http://www.hornady.com/store/GMX (3 pgs.).

(56) References Cited

OTHER PUBLICATIONS

Hornady Manufacturing, FTX® Rifle, FTX® Handgun, and XTP® & XTP® Mag™ product information sheets, Hornady 2015 Product Catalog, May 19, 2015 (5 pgs.).
JBM Ballistics, LLC, "Bullet Lengths", accessed online Mar. 4, 2014, at: http://www.jbmballistics.com/ballistics/lengths/lengths.shtml (77 pgs.).
SAAM1 (Sporting Arms and Ammunition Manufacturers' Institute, Inc.), Maximum Cartridge/Minimum Chamber Standards specification sheets, accessed May 2015. (10 Pgs.).
Wikipedia, "9 mm caliber", accessed online Mar. 4, 2014, at: https://en.wikipedia.org/wiki/9_mm_caliber (6 pgs.).
Wikipedia, "List of handgun cartridges", accessed online Mar. 4, 2014, at: http://en.wikipedia.org/wiki/List_of_handgun_cartridges (17 pgs.).
Gleichman and Teegarden "Cartridges, Caps, and Flints: A Primer for Archaeologists" Native Cultural Services (2005) pp. 3-27.

HANDGUN CARTRIDGE WITH SHEAR GROOVE BULLET

This application is a Continuation-In-Part application of U.S. patent application Ser. No. 14/722,076, filed May 26, 2015, which claims the benefit of U.S. Provisional Application No. 62/002,600, filed May 23, 2014, and claims the benefit of U.S. Provisional Application No. 62/696,804, dated Jul. 11, 2018.

FIELD OF THE INVENTION

The present invention generally relates to cartridges for use with handguns. More particularly, to a cartridge comprising a case with an inserted jacketed bullet having a shearing groove and a circumferential hinge imparted in the jacket of the bullet.

BACKGROUND OF THE INVENTION

Contemporary cartridge and bullet design and construction have dramatically increased the terminal effectiveness of many premium line law enforcement handgun projectiles. Much of the improved effectiveness has been driven by FBI standardized terminal performance test protocols (FBI Penetration Test), which are a series of practically oriented tests to measure a bullet's ability to meet these performance standards. The tests measure expectable penetration in soft tissue after passing through particular barriers, including bare ballistics gel, heavy clothing, drywall, plywood, sheet metal and auto glass. The tests also measure uniform expansion and bullet retention weights after passing through such barriers and impacting soft tissue. An unresolved issue with the current technology of expanding bullets is that many have difficulty in maintaining integrity through such barriers. In particular, shifts in the FBI protocol scoring criteria have seen reduced performance against auto-glass.

One of the largest issues in bullet development is creating a design that performs well through all the FBI Protocol barrier tests. The most challenging is the Auto Glass test because it creates "wings" that protrude from the bullets that reduces penetration to unacceptable levels. The purpose of the FBI Penetration Test is to determine the following information regarding a particular cartridge: 1) the penetration performance of the cartridge's projectile, throughout the series of six tests (depth of penetration to nearest 0.25 inch, expansion of projectile, retained weight of the projectile); 2) the average velocity, both from a test barrel and a service weapon; and 3) the average accuracy, both from a test barrel and a service weapon. The test medium utilized is 10% ballistic gelatin (nominal), by weight.

Of the six tests, the Automobile Glass involves firing through one piece (15"×18") of A.S.I. ¼ inch laminated automobile safety glass which is set at an angle of 45° to the horizontal and 15° to the side, resulting in a compound angle. The gelatin block is placed 18 inches behind the glass. This test event simulates a shot taken at the driver of a car from the left front quarter of the vehicle.

The Automobile Glass test has resulted in poor performances. In particular, jackets of hollow-point jacketed bullets, typically non-bonded, can be cut and torn by the hard and sharp edge of the fractured glass. This damage will then propagate sufficiently down and around the projectile form to mechanically separate the jacket from the lead core. The resulting terminal performance of the projectile has been substantially compromised due to the loss of mass and loss of expanded diameter. The loss of mass will typically reduce the residual momentum of the projectile sufficiently to prevent it from penetrating the prescribed minimum of 12 inches into ballistics gelatin. This insufficient penetration is viewed and scored as a major defect in performance by the FBI. Upon impact with the glass, the core of the projectile collapses and forward portions of the jacket peal back under the force of the impact and collapsing core. The impact forces contribute to a separation of the jacket, or jacket portions, from the core, which negatively impacts mass retention and performance. In contrast, a favorable result is one in which the jacketed bullet may expand in response to the pressure created by the impact, which is referred to as mushrooming or upset, but the bullet jacket remains connected to the core and the bullet maintains mass integrity to effectuate the required penetration.

The ballistics of cartridge bullets for handguns, including interior ballistics, which studies the projectiles movement inside the gun, exterior ballistics, which studies the projectiles movement between the muzzle and the target, and most notably terminal ballistics, which studies the projectiles movement in the target and is of high relevance in the FBI Standards Tests, is highly effected by cartridge and bullet design and construction. Design and construction of cartridges, including the cartridge case and the bullet inserted therein, effect issues dealing with performance, mass and jacket retention, and bullet expansion of a bullet fired through barriers prior to contacting a target. As such, specifics of the design and construction of handgun cartridges and cartridge elements, including cases, bullets and the insertion and engagement of the bullets in the cases, have direct effects on performance.

A cartridge for use handguns is a single unit of ammunition consisting of a case, primer, propellant and a projectile or bullet. The cartridge case is the main body of a single round and typically includes a body, which contains the propellant, and a case head or head, which is the rear end of the cartridge case, in which the primer or priming is inserted and the surface upon which the head stamp identification is imprinted.

Cartridges are typically either centerfire or rimfire. Centerfire cartridges are any cartridge intended for use in rifles, pistols and revolvers that has its primer central to the axis in the head of the case. Rimfire cartridges are flange-headed cartridges, wherein the priming mixture is inside the rim cavity.

Cartridges can further be categorized as rimless, rimmed or semi-rimmed. A rimless cartridge is a centerfire cartridge whose case head is of the same diameter as the body and has a groove turned forward of the head to provide the extraction surface. Rimmed cartridges have a rimmed or flanged head that is larger in diameter than the body of the case. Cartridges that are semi-rimmed include centerfire cartridges having a case head only slightly larger in diameter than the case body and an extractor groove just forward of the head. Some cartridges have a rim that is significantly smaller than case body diameter. These are known as rebated-rim designs, and almost always allow a handgun to fire multiple caliber cartridges with only a barrel and magazine change.

Revolver cartridges are considered rimmed cartridges, having a rim at the base of the case that is larger than the case body and which seats against or into the cylinder block to provide headspace control and to provide for easy extraction.

Pistol cartridges, such as semi-automatic pistol cartridges, are predominantly rimless. Such cartridges have a rim of the same diameter as the case body. An extractor engages this rim by entering a groove near the base of the case.

The projectile, or bullet, of conventional cartridges is typically a jacketed bullet. This is a bullet having an outer metallic cover over a core, which is commonly lead. Variations include full jacket, wherein the bullet jacket encloses most of the core with the possible exception of the base, and semi-jacketed, which is a bullet with a partial jacket exposing a lead nose. Jacketed bullets include bonded jackets, wherein the jacket is bonded to the inner core to create a surface to surface engagement between the jacket and the core, and non-bonded bullets, wherein the jacket is not bonded to the inner core material.

Further variations include hollow-point bullets, wherein the bullet includes a cavity in the nose to facilitate expansion upon impact. Such expansion is commonly referred to as bullet upset or mushrooming. Bullet upset in Exterior Ballistics is the expansion of a bullet upon impact with target. A mushroomed bullet is a bullet that has expanded upon impact into a mushroom-like shape. It is desirable to design and construct the cartridges and bullets so as to control such expansion to achieve desired results.

There have been numerous efforts to design standard caliber bullets for handguns to improve their performance. Such efforts have been directed to improving mass retention of the bullet after it strikes a barrier to maximize the impact penetration of the bullet on the target and to improving expansion of the bullet after it strikes its target to maximize damage to the target. Fragmentation or separation of the jacket causes a dramatic decrease in kinetic energy of individual components and thus the penetration and stopping power. In non-bonded jacketed bullets, such attempts in keeping the jacket and core coupled together on impact include creating a mechanical lock between the jacket and the core.

Issues also arise with bonded bullets. While bonded bullets have a reduced tendency to fail minimum penetration due to mass loss through these types of barriers, they are not widely accepted by the law enforcement market due to the increased expense of fabrication required to either electrolytically or chemically bond the jacket to the lead core.

It would be desirable to provide a design for such ammunition which improves jacket retention and controlled expansion resulting in terminal performance which meets current FBI standards, notably the Automobile Glass Test. It would be further desirable to provide such a design that is conducive to consistent performance and additionally requires minor modification to current toolsets allowing for minimal manufacturing cost increase.

SUMMARY OF THE INVENTION

The present invention relates to handgun cartridges, in particular rimless cartridges for pistols, with inserted bullets having a circumferential shear groove formed in the outer surface of the bullet jacket. The shear groove may act to release, separate or shear petals formed as a result of over-expansion after impact with the hard surfaces, allowing for better performance under current FBI standardized terminal performance test protocol conditions.

In embodiments, a rimless cartridge comprising a case and a bullet mounted therein. The bullet comprises a jacketed malleable core having a cylindrical body portion, an ogive or tapered portion, and a plurality of longitudinally extending paths of weakness, such as skives, formed in the ogive portion and defining petals there between and extending rearward from the mouth. The bullet comprises a circumferential shear groove positioned between a forward circumferential indentation imparted in the ogive portion and rearward circumferential indentation imparted in the body portion of the jacket. Upon firing and penetration of hard material, the forward circumferential indentation acts as a hinge folding normal expansion petals back and the shear groove acts to release, separate or shear the petals in the event of bullet impact with the hard surfaces results in over-expansion.

In embodiments, a rimless cartridge for firing in a handgun. The rimless cartridge comprises a case and a bullet inserted into a mouth of the case, wherein the bullet comprises a core and a jacket of metallic material at least partially enveloping the core. The bullet includes rearward cylindrical body portion and a forward ogive portion, wherein the forward ogive portion has a forward cavity and may include paths of weakening or skives formed in the jacket. In embodiments, the bullet may include a rearward circumferential indentation, a forward circumferential indentation and a circumferential shear groove positioned between the rearward circumferential indentation and the forward circumferential indentation, all formed or imparted in the jacket of the bullet. In embodiments, the shear groove extends into the jacket and may form an outwardly opening acute angle. In embodiments, after impact with a hard material, such as glass, the forward circumferential indentation acts as a hinge, folding normal expansion petals back. The shear groove acts to prevent over expansion or upset of the bullet by releasing, separating or shearing the expansion petals allowing securement of the core in the remaining jacket portion and the bullet to maintain mass for more effective penetration.

In an embodiment, a cartridge for firing in a handgun, wherein the rimless cartridge comprises a case and a bullet inserted into a mouth opening of the case. The bullet may comprise a core and a jacket of metallic material at least partially enveloping the core and include a rearward cylindrical body portion and a forward tapered portion. The bullet may further include a forward cavity and a plurality of skives defining a plurality of expansion petals in the jacket, each skive being axially oriented and having a forward end and a rearward end. In embodiments, the bullet may have a rearward circumferential indentation formed in the rearward cylindrical body portion, a forward circumferential indentation formed in the tapered portion and a circumferential groove positioned axially between the rearward circumferential indentation and the forward circumferential indentation.

In embodiments, the forward circumferential indentation may be axially positioned at or adjacent to the rearward end of at least one of the plurality of skives. In an embodiment, the circumferential groove is formed in the tapered portion of the bullet. The circumferential groove may extend into the jacket and form an outwardly opening acute angle. In an embodiment, the acute angle may be about 60 degrees. The circumferential groove may further have a bottom flat at an innermost portion of the circumferential groove.

In embodiments, a handgun cartridge comprising a case with a head and a case wall extend forwardly from the head defining an interior and a forward case mouth with propellant in the interior and a bullet in the case mouth, the bullet having a forward end, a rearward end, and an axis, the bullet comprising a core and a jacket at least partially enveloping the core, wherein the bullet has a cylindrical body portion and a tapered forward portion, the forward portion having a nose portion with an axially extending indentation therein, the jacket covering the body portion and at least partially covering the tapered forward portion, a plurality of skives defined in the jacket on the tapered portion and extending to the nose portion, a first groove extending circumferentially around the tapered forward portion in the jacket at rearward ends of the plurality of skives, the first groove extending a first groove depth into the jacket and having an first groove axial width, a second groove extending circumferentially around the tapered forward portion and positioned rearwardly of the first groove, the second groove extending a second groove depth into the jacket and having a second groove axial width, the second groove depth being greater than the first groove depth, a third groove extending circumferentially around jacket at the cylindrical body portion, the third groove having a third groove depth and a third groove axial width, the third axial width being greater than the first groove axial width and greater than the second groove axial width. In embodiments, the first groove provides a hinge for a plurality of pedals formed upon impact of the bullet with a target, the second groove forms a separation region for the plurality of pedals formed upon impact of the bullet with the target, and the third groove provides retention of the core in the cylindrical portion with the jacket at the cylindrical portion.

In embodiments, the forward circumferential indentation defines a first diameter of the bullet and the circumferential groove defines a second diameter. In an embodiments, the first and second diameters may be substantially equal.

In embodiments, the circumferential groove may be a cut-in cannelure, a formed groove, wherein material is removed in forming the groove, or a rolled-in groove, wherein the groove is formed without removing material. In an embodiments, the circumferential groove may be formed such that a cross section of the bullet at the forward circumferential indentation has a diameter of about 0.333 inches. In an embodiment, cross sections of the bullet at the forward circumferential indentation and at the shear groove each have a diameter of about 0.333 inches.

In embodiments, the bullet of the cartridge may a caliber chosen from the group consisting of 9 mm caliber, 10 mm caliber, 40 caliber and 45 caliber. In an embodiment, the bullet has a caliber and grain weight chosen from the group comprising 9 mm, 100-160 gr.; 40 s&w, 135-210 gr.; 45, 155-250 gr.; 357 sig, 100-160 gr.; 45 g.a.p., 155-250 gr.; and 10 mm auto, 135-210 gr. In an embodiments, the bullet is a 9 mm caliber bullet.

In an embodiment, a method of making a rimless cartridge sized and adapted to be used in a handgun comprising the steps of: a) drawing a sheet metal blank into a cup shaped jacket blank having a flat bottom and a generally uniform thickness wall; b) forming a malleable metal core in the cup shaped jacket blank against the bottom by swaging or molding the core directly into the blank; c) providing a plurality of axially oriented skives through the jacket wall; d) forming a cavity in the metal core at the open end of the cup shaped blank; e) deforming the end of the blank into an ogival or tapering front end portion of the bullet, wherein in the plurality of skives are formed in the tapering front end portion; f) imparting a rearward circumferential indentation into the body of the cup shaped jacket blank, such that jacket material is forced radially inward creating an internal circumferential indentation which extends into the bullet core; g) imparting a forward circumferential indentation into the body of the cup shaped jacket blank, wherein the forward circumferential indentation is formed in the tapering front end portion; and h) imparting a circumferential groove into the body of the cup shaped jacket blank forward of the rearward circumferential indentation and rearward of the forward circumferential indentation.

In an embodiments, the circumferential groove may formed in the tapering front end portion and the forward circumferential indentation may be axially positioned at or adjacent to a rearward end of at least one of the plurality of skives. In an embodiment, the circumferential groove extends into the jacket, forming an outwardly opening acute angle. The acute angle may be about 60 degrees.

In embodiments, diameters of the bullet at the circumferential groove and at the forward circumferential indentation may be equal. In an embodiment, the diameters may be about 0.333 inches. In an embodiment, the length 146 of the bullet may be about 0.645 inches.

In embodiments, the shear groove circumferentially imparted in the jacket of the bullet approximately adjacent to the diameter transition portion of the bullet causes the jacket to shear or tear away when passing through auto glass, enabling deeper penetration in the FBI Auto Glass protocol test. The location and geometry of the feature is such that in all other FBI test barriers, this shear groove does not cause the jacket to shear away, only in the auto glass test. In embodiments, the shear groove may be either a cut in cannelure or groove where material is removed in the manufacturing process, or it can be rolled in without removing material.

In some application situations the bullet has to go through hard material, such as glass, before it penetrates the target soft material. In such situations, the hard material may cause the bullet to over expand, creating a larger front profile. This can slow the bullet down through target softer material, reducing the bullets penetration. In embodiments, the shear groove of the bullets herein counteracts the over expansion by allowing the expanding portion, which may include normal expansion petals and core segments, of the bullet to shear away, preventing over-expansion. If the bullet was deforming past a certain point, instead of it stopping the bullet short on penetration, the expanding forward portions of the bullet can break away to allow the core of the bullet to still reach target penetration. In the above discussed FBI testing protocol, this means 12 inches into a gelatin block.

During upset of the bullet, the shear groove may reduce forces that can cause separation of the jacket from the core initiated upon impact. In embodiments, the shear groove may be positioned and formed to act as a stress riser allowing tearing away of forward portions of the bullet while encountering hard barriers such as laminated auto-glass and the automobile glass in the Automobile Glass Test, allowing the remaining jacketed rear portion of the bullet to penetrate the soft target to an acceptable depth. The intentional mechanical separation of petal and segment material and the rearward jacketed core prevents the mechanical damage from propagating to the rear of the bullet allowing it to remain fully intact ensuring adequate mechanical retention of the jacket to the core through difficult barriers.

In an embodiment of the invention, there is disclosed a rimless cartridge for firing in a pistol. The rimless cartridge comprises a case comprising a forward cylindrical wall connecting to a rearward head having a neck and an annular flange. The forward cylindrical wall terminates at a leading edge and defines a bullet opening. The rearward head has an outermost diameter no greater than that of the forward cylindrical wall. The rimless cartridge further comprises a bullet inserted into the opening, the bullet comprising a core and a jacket of metallic material at least partially enveloping the core. The bullet has an aspect ratio of length to outermost diameter of about 1.05 to 2.00; and propellant in the case rearward of the bullet. The bullet has a rearward cylindrical body portion and a forward ogive portion, the forward ogive portion having a forward cavity and radial segments formed in the core and corresponding paths of weakening formed in the jacket. The rearward cylindrical body portion has a rearward circumferential indentation and a forward circumferential indentation position in the ogive portion of the bullet. A shear groove is position between the indentations and extends into the jacket. In embodiments, the shear groove forms an outwardly opening acute angle with a flat portion at the apex.

Various embodiments can include non-bonded expanding bullets. Embodiments include cartridges having various calibers including: 9 mm caliber, 10 mm caliber, 40 caliber and 45 caliber. The bullet can have an aspect ratio of length to outermost diameter of about 1.05 to about 2.00. The aspect ratio of the rimless cartridge length to the bullet diameter can be about 2.30 to about 4.45. In some embodiments, the bullet of the cartridge can have a ratio of the bullet length to the bullet diameter is from about 1.35 to about 1.95. In some embodiments, the bullet is a caliber chosen from the group comprising: 9 mm caliber, 10 mm caliber, 40 caliber and 45 caliber.

In some embodiments, the rimless cartridge of the present invention includes a case having a leading edge defining an opening and a bullet inserted into the opening of the case. The bullet comprises a jacketed core having a rear end and a forward end having an opening, a body portion, an ogive portion, and a transition portion. The transition portion is positioned between the body portion and the ogive portion. The bullet further includes a shear groove position adjacent the transition portion. In embodiment, the shear groove is positioned forward of the transition portion.

Aspects and embodiments of the present invention are advantageous at least in that the cartridges of the present invention requires only minor modification to current toolsets allowing for minimal cost increase, if any, while markedly improving the terminal performance of the resulting cartridge. The design further does not require substantive development of new and complex components or processes to allow fabrication of production volumes and can be implemented on conventional, in place equipment.

The above summary of the various representative aspects of the invention is not intended to describe each illustrated aspect or every implementation of the invention. Rather, the aspects are chosen and described so that others skilled in the art can appreciate and understand the principles and practices of the invention. The figures in the detailed description that follow more particularly exemplify these aspects.

Still other objects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawing and description are to be regarded as illustrative in nature, and not as restrictive.

BRIEF DESCRIPTION OF THE DRAWINGS

The patent application contains at least one drawing executed in color. Copies of this patent with color drawing(s) will be provided by the Patent and Trademark Office upon request and payment of the necessary fee.

The invention can be completely understood in consideration of the following detailed description of various aspects of the invention in connection with the accompanying drawings, in which.

Figure 1A:
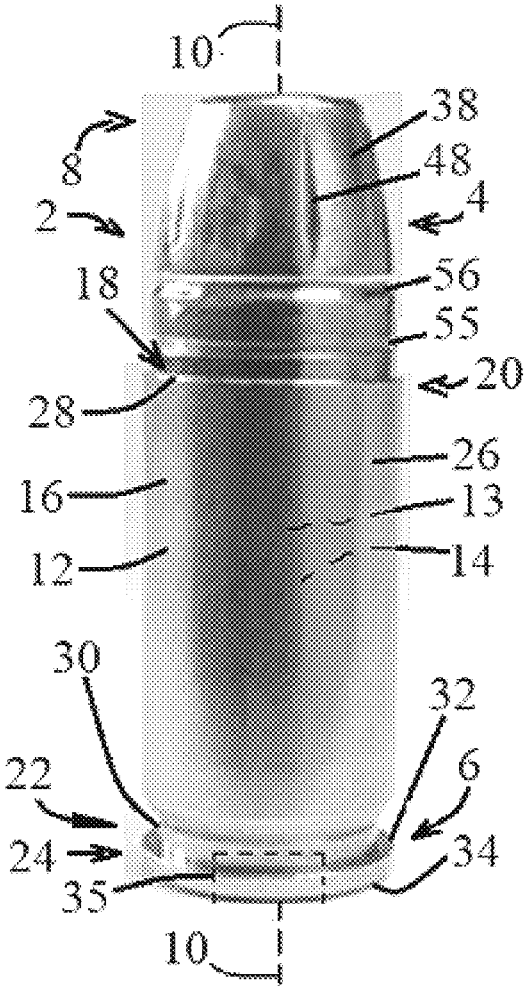
FIG. 1A is a front perspective view of a cartridge in accordance with an embodiment of the invention.

While the present invention is amenable to various modifications and alternative forms, specifics thereof have been shown by way of example in the drawings and will be described in detail. It should be understood, however, that the intention is not to limit the present invention to the particular aspects described. On the contrary, the intention is to cover all modifications, equivalents, and alternatives falling within the spirit and scope of the present invention as defined by the appended claims.

DETAILED DESCRIPTION

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2A:
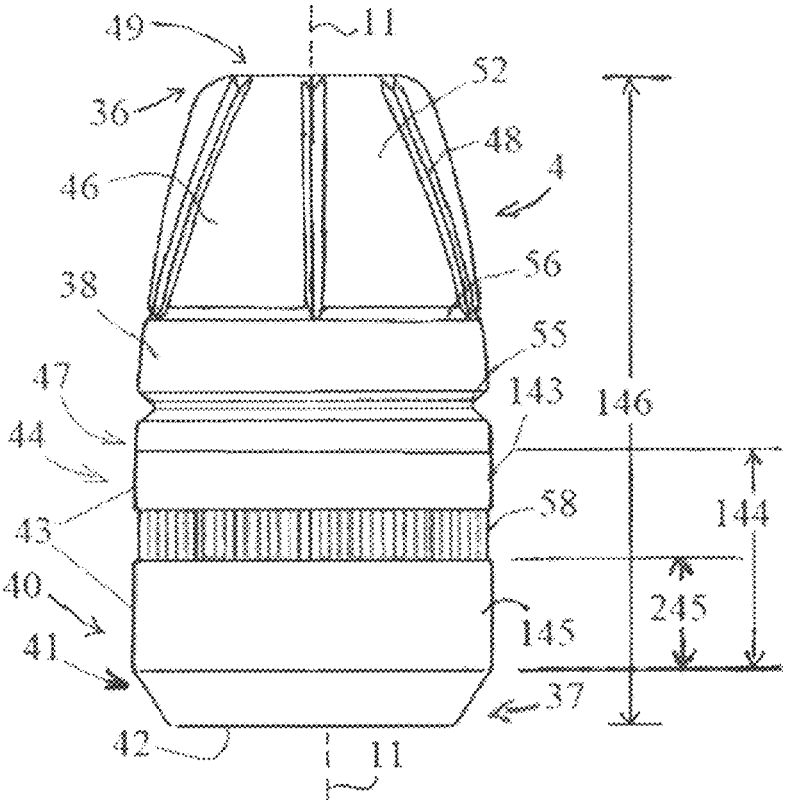
FIG. 2A is a front view of a bullet in accordance with the invention.

FIG. 1A shows a cartridge 2 and FIG. 2A shows a bullet 4 constructed in accordance with an embodiment of the invention. The cartridge 2 shown is a rimless cartridge, which is a centerfire cartridge whose case head is of the same diameter as the main body of the case. In embodiments, the cartridge 2 may include a rear end 6, a forward end 8 and a longitudinal axis 10. The cartridge 2 may further include a case 12 having an interior cavity 13, which may contain propellant 14, and a bullet 4, the bullet being received and held partially within the interior cavity 13.

In embodiments, the case 12 may include a body 16, a case mouth 18 at a forward end 20 and a case head 22 at the rearward end 24. The body 16 may include a wall 26, which may be cylindrically shaped around the axis 10 of the cartridge 2 and define the interior cavity 13. The wall 26 may have a cross-sectional symmetry and an outer diameter that may be substantially constant along its length. At least a portion of the body wall 26 may define an outer most diameter of the cartridge 2. The forward end 20 of the case 12 may include a forward periphery or leading edge 28 which defines the case mouth 18. The case mouth 18 may be shaped to receive and hold the bullet 4 via a friction fit engagement. In an embodiment, the bullet 4 may be held in the mouth 18 of the case 12 via an outer crimp in the forward end 20 of the case 12.

In embodiments, the case head 22 may include a groove 30 that may provide an extraction surface and a flange or rim 32 having an outer diameter. The case head 22 further may define a bottom 34 of the case 12 and may further house a primer 35 (shown in phantom lines). As mention above, the case head 22, including the rim 32, may be the same diameter as the case wall 26. In an embodiment, the rim 32 may be of lesser diameter.

Figure 1B:
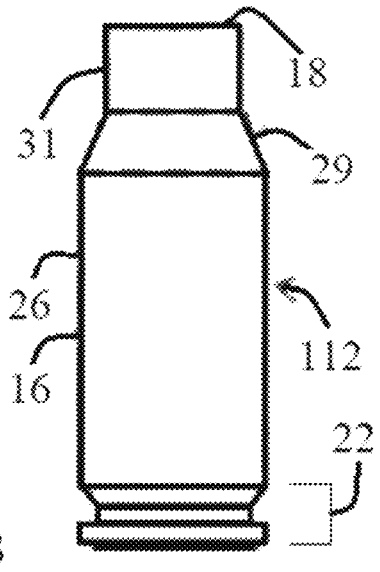
FIG. 1B is a side view of a cartridge case in accordance with an embodiment of the invention.

In an embodiment, the case may be a bottleneck case 112, as shown in FIG. 1B. The bottleneck case 112 may include a body 16 having a case wall 26 with an outer diameter and a distinct angular transition portion 29 necking down to a smaller diameter at a neck portion 31 of the case 112. The neck portion 31 may include a forward edge, which defines the case mouth 18.

Figure 3:
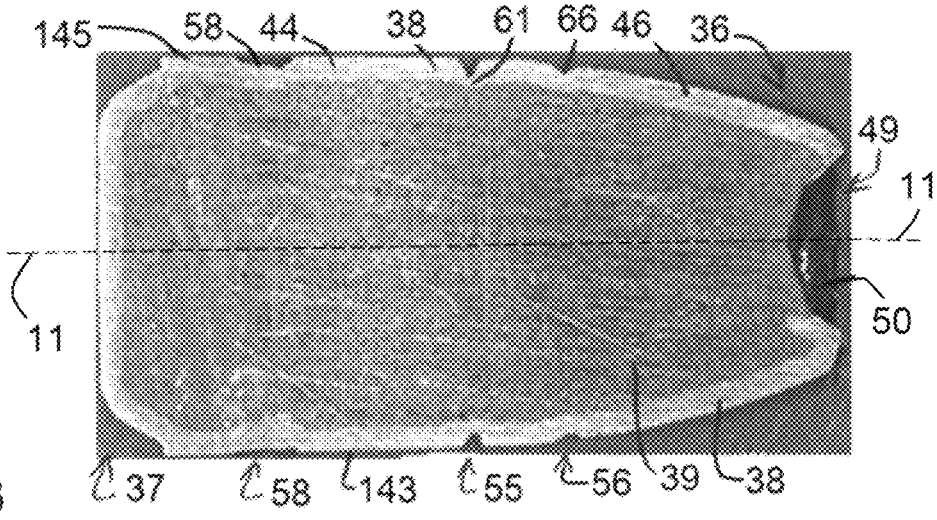
FIG. 3 is a side cross-section view of a bullet in accordance with the invention.

FIG. 2A illustrates a bullet 4 in accordance with an embodiment of the invention. FIG. 3 shows a cross-section view of the bullet 4, revealing a core 39. In embodiments, the bullet 4 may include a forward end 36, a rearward end 37, a cylindrical body portion 44 having a width 45, a forward tapered portion configured as an ogive portion 46, a length 146, a jacket 38 and the core 39. The jacket 38, which may form the outermost surface of the bullet 4, may house and confine the core 39. The bullet 4 may further include a base 40, which may comprise a heal portion 41 and a bottom 42. In embodiments, the heal portion 41 may be angled radially inward toward the bottom 42, forming a boat tail shape. In embodiments, the diameter of the base 40 may be in line with that of the body portion 44 of the bullet 4.

In embodiments, the body portion 44 may have a length 144 forward from the heal portion 41. In some embodiments, wherein the heal portion 41 is not boat tail shaped, the length may be forward from the bottom 42. In an embodiment, the heal portion 41 may be angled and have a radius of about 0.020 inches.

In embodiments, the outermost surface of the body portion 44 may comprise one or more annular outer surfaces or bearing surfaces 43. At least in the present application, "bearing surface" is the radial outermost surface portions of the bullet 4 that come into direct contact with the interior surface of a barrel bore of a firearm when moving through the barrel. In embodiments, bearing surfaces may also be considered annular outer surfaces of the body 44 of the bullet 4 with the largest diameters.

In at least some embodiments, the bearing surface 43 comprises a forward bearing surface 143 having a length 243 and a rearward bearing surface 145 having a length 245. The body portion 44 may be substantially cylindrically shaped with cross-sectional symmetry in the lengths of the bearing surfaces 143, 145. In embodiments, the cross-sectional diameter of the body 44 may be substantially constant in diameter along the bearing surfaces 143, 145. In some embodiments, the rearward bearing surface 145 may be axially longer than the forward bearing surface 143, as shown in FIG. 2A. In some embodiments, the forward bearing surface 143 may be axially the same or longer than the rearward bearing surface 145. In an embodiment, the body portion 44 may have a cylindricity ( ⌭ ) 69 of about 0.0005, excluding the rearward circumferential indentation 58 and the heal portion 41.

In embodiments, the ogive portion or ogive 46, may be a portion of the bullet 4 that is forward of bearing surface 43. The ogive portion 46 may have circumferential symmetry around an axis 11 of the bullet 4 and may vary in rate of change of diameter or in curvature of its outer side profile arc from the forward end 36 rearward to the forward end of the body 44. In embodiments, the ogive portion 46 may have a substantially decreasing diameter or a positive or inward curvature substantially from bearing surface 43 to the forward end 36 of the bullet 4. The ogive 46 can be generally conical or frustoconical in shape. In various embodiments of the invention, ogive 46 configurations include a tangential ogive, a secant ogive and a truncated cone.

In an embodiment, the ogive portion 46 may have a curvature with a radius 59 of about 1.017 inches that has a center 63 that is about 0.331 inches from the forward end of the bullet. In embodiments, the tapered portion 46 may have about a 3 percent taper.

In embodiments, the ogive or forward tapered portion 46 may begin at a transition point 47, which may be the forward end of the forward-most bearing surface. The transition point 47 is a circumferential position around the axis 11 on the outside of the bullet 4 where the termination of the rearward portion of the ogive or tapered portion 46 axially meets the forward-most portion of the body 44. In embodiments, this transition position or point 47 is the position at which the cross-sectional diameter of the bullet 4, moving from the body portion 44 forward, begins to decrease and does not increase thereafter to the forward end 36 of the bullet 4, accept for forward groove or indentation. In an aspect of the invention, the ogive portion 46 may have a positive decrease in diameter continuously, accept for the above mentioned forward groove or indentation, from the transition position 47 to the forward end 36 of the bullet 4.

In embodiments, the forward most portion of the forward end 36 of the bullet 4 may be referred to as the nose or meplat. The meplat may be a small diameter, generally spherical portion at the forward end 36 of the bullet. In embodiments, the meplat may define an opening 49 exposing a cavity 50 in the forward end of the core 39. In embodiments, the cavity 50 may be a shallow cavity. In embodiments, the cavity 50 may be about 0.050+−0.005 inches. In at least some embodiments, the cavity 50 may have a cylindrical or curved sidewall profile or may have a generally conical or frustoconical profile. The opening 49 is considered to be an opening and the cavity 50 is considered to be a cavity, whether or not there is an insert or plug inserted or included in the opening 49 or cavity 50. The opening 49 and cavity 50 may include a plug or insert inserted therein or can be filled with a polymeric material. The plug or insert can comprise polymeric material. In embodiments, the opening 49 may have a diameter of about 0.172 inches. In embodiments, the cavity 50 may have a depth 53 of about 0.05+/−0.005 inches.

The ogive 46 may include a plurality of skives or elongated paths of weakening 48 in the jacket 38 extending continuously or intermittingly longitudinally from the meplat and opening 49 rearward toward the rearward end of the ogive 46, defining a plurality of petals 52 circumferentially arranged around the ogive 46. In at least some embodiments, the jacket 38 may comprise five petals 52. The elongated paths 48 may extend rearward from the forward end 36 of the bullet 4 to an extent necessary to achieved desired upset characteristics.

The paths of weakening 48 may be in the form of radially oriented scoring, meaning a path, continuous or intermitting, of inward folding of the jacket material, creasing of the jacket material, imparting skives and/or of a cut, cuts or engraving in the jacket material, which may involve creating a plane of detachment or removal of material in the jacket 38, either partially or entirely radially through the jacket 38 material. After the scoring, the adjacent petals 52 may be physically separated or in contact in a pre-fired resting state. The paths of weakening 48 also can be in the form of an elongated path, continuous or intermitting, of annealing, hardening, thinning or a decrease of density. Nonexclusive examples of scoring and petal formation may be found in U.S. Pat. No. 6,805,057, which is incorporated herein by reference in its entirety. In an embodiments, a plurality of skives may be imparted in the forward end of the tapered or ogive portion via a die press.

In embodiments, the forward end of the core 39 may also include paths of weakening defining core segments 54. In the context of the core 39, the paths of weakening may be in the form of scoring, meaning a path, continuous or intermitting, of a cut, cuts or engraving in the core material. This may involve creating a plane of detachment or removal of material in the core 39, either partially or entirely radially through the core 39 material. In an embodiment, segments 54 may be formed with a star punch. This may be done in conjunction with the formation of skives in the jacket with a die press.

Figure 9:
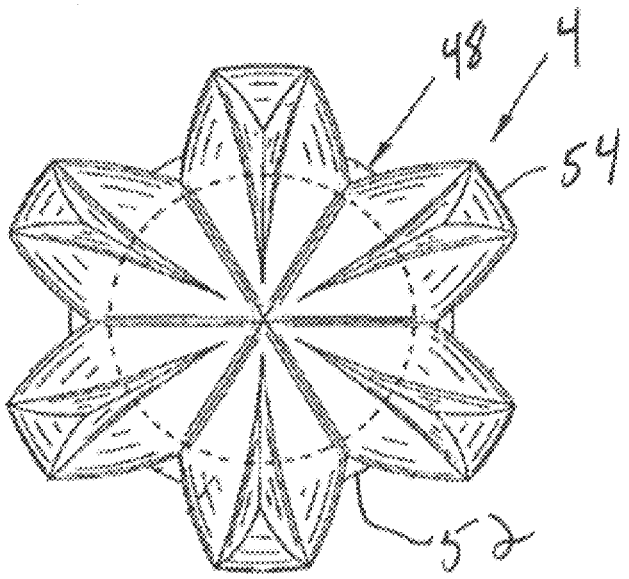
FIG. 9 is a top plan view of an upset bullet in expanded condition in accordance with an embodiment of the invention.
Figure 10:
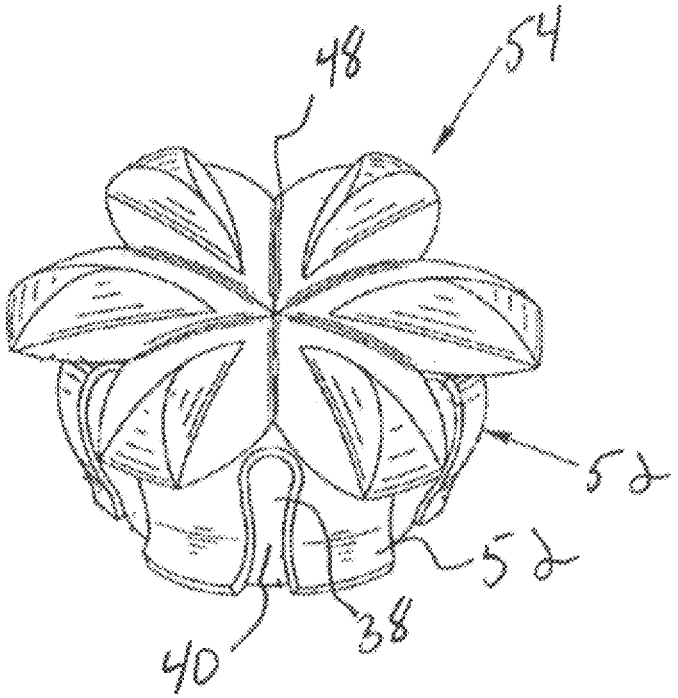
FIG. 10 is a side perspective view of the upset bullet shown in FIG. 9.

The paths of weakening in the forward portion of the core 39 may be radially aligned about an axis 11 of the bullet 4 and the cavity 50 of the core 39. After scoring, adjacent segments 54 may be physically separated or in contact in a pre-fired resting state. An example of segments 54 of an upset bullet is shown in FIGS. 9-10.

Figure 5:
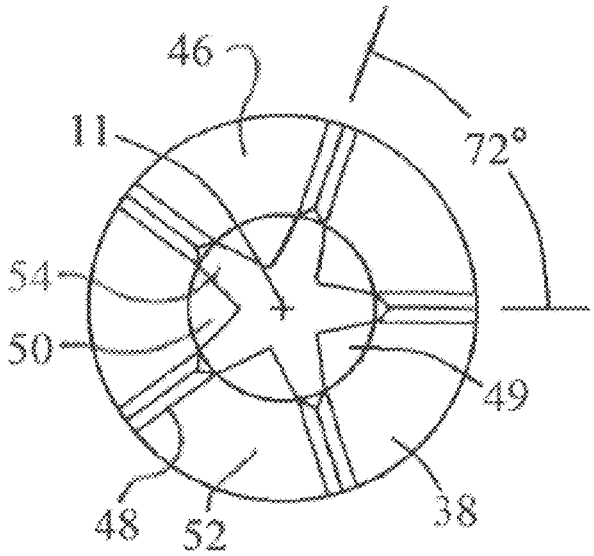
FIG. 5 is a top plan view of a bullet in accordance with an embodiment of the invention.

In an embodiment, as seen in FIG. 5, five segments 54 may be formed in the ogive portion of the core 39 and each segment 54 may have a radial arc measuring about 72°. In embodiments, the number and circumferential arrangement of the segments 54 may vary. As an example, the core 39 may include 2 or more segments 54 have the same or varied radial arcs.

In embodiments, paths of weakening in the forward portion of the core 39 may extend rearward from the forward end 36 of the bullet 4 to an extent necessary to achieved desired upset characteristics. In embodiments, the paths of weakening in the jacket 38 and core 39 may coextend reward to about the same extent. The paths of weakening in the core 39 may also be in the form of an elongated path, continuous or intermitting, of annealing or hardening. Such elongated paths and segments 54 of the core 39 that may correspond to elongated paths 48 and petals 52 of the jacket 38. Nonexclusive examples of this may be found in U.S. Pat. No. 6,805,057, which is incorporated herein by reference in its entirety.

In embodiments, the cavity 50 and elongated paths of weakening defining core segments 54 may be formed by the insertion of a fluted punch. The fluted punch may be generally conical in shape, with longitudinal protrusions uniformly spaced radially around the outside of punch. When inserted into the forward end of the core 39, longitudinal protrusions cut radially outward through the core material, forming the core segments 54. The longitudinal protrusions may penetrate entirely through or to an extent such that a thin annular layer of core material radially surrounds the core segments 54.

Figure 4:
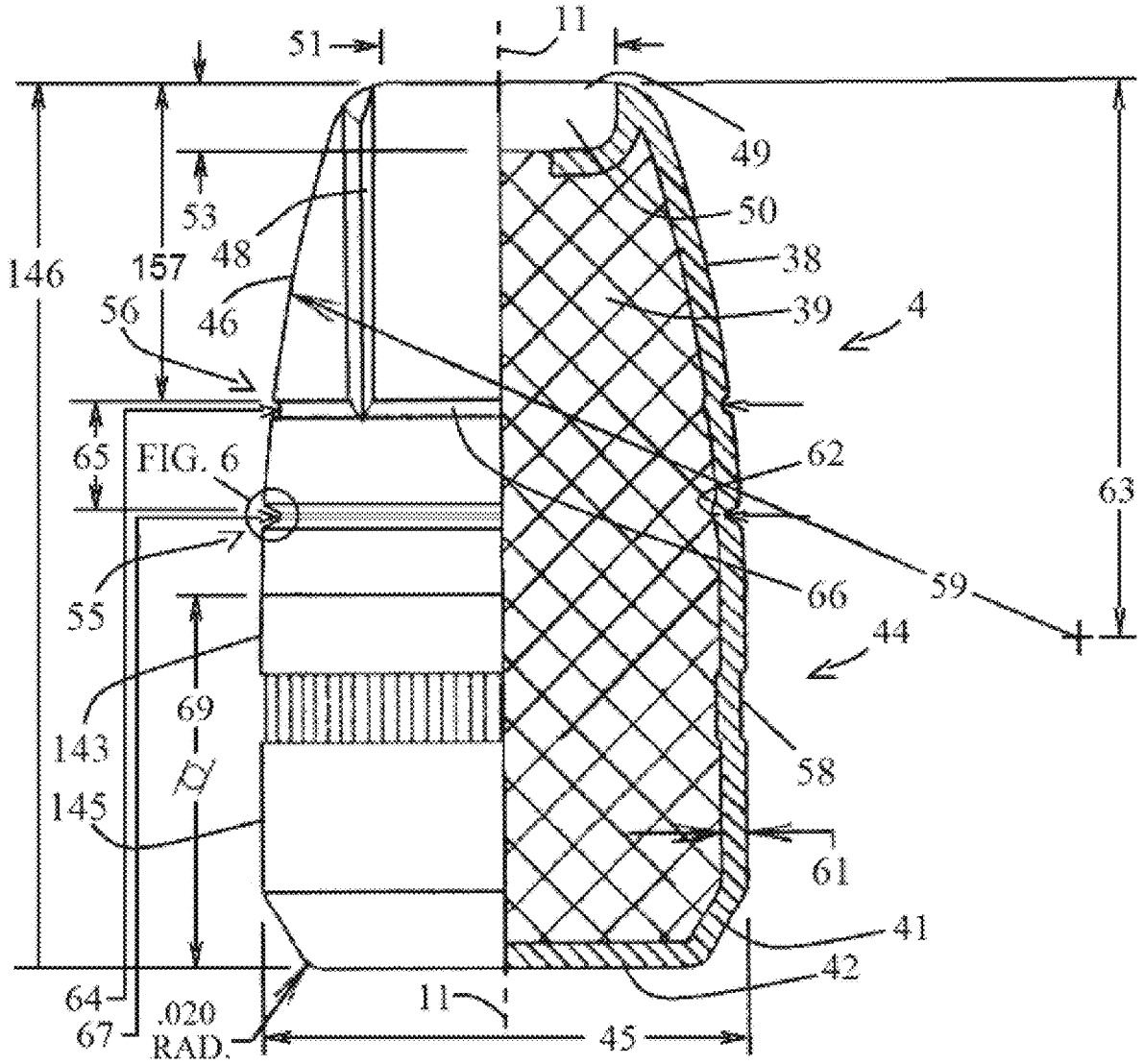
FIG. 4 is a side view with a partial cross-section view of a bullet in accordance with the invention.

In embodiments, the bullet 4 may comprise a first groove or forward circumferential indentation 56 having a diameter 64, a circumferentially extending second groove configured as a shear groove 55 having a diameter 67 measured through the center, and a third groove configured as a rearward circumferential indentation 58 formed in the jacket 38. The shear groove 55 and forward 56 and rearward 58 circumferential indentations may be axially spaced along the length 146 of the bullet 4, with the forward circumferential indentation 56 in the forward most position and the rearward circumferential indentation 58 in the rearward most position and the shear groove 55 axially positioned between, as best seen in FIGS. 2-4. In embodiments, the shear groove may be axially positioned forward and adjacent the transition point 47.

Figure 2B:
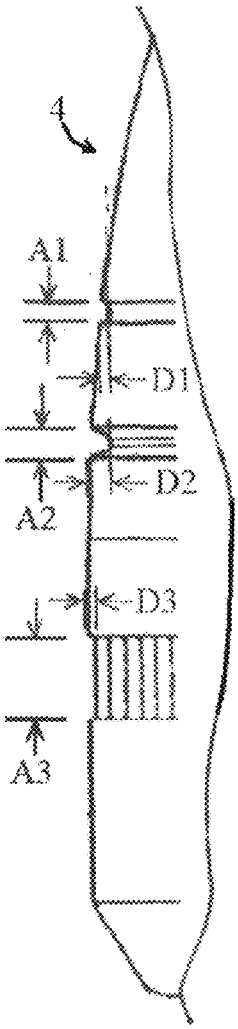
FIG. 2B is a partial side view of the bullet of FIG. 2A.

Referring to FIG. 2B, the first groove having a first groove depth of D1, and a first groove axial width of A1, the second groove having a second groove depth of D2, and a second groove axial width of A2, the third groove having a third groove depth of D3, and a third groove axial width of A3.

In an embodiment, the second groove depth D2 may be about 0.011 inches.

In an embodiment, the circumferential groove or shear groove 55 may be at a distance 65 of about 0.075 inches rearward from the forward circumferential indentation 56.

Figure 7:
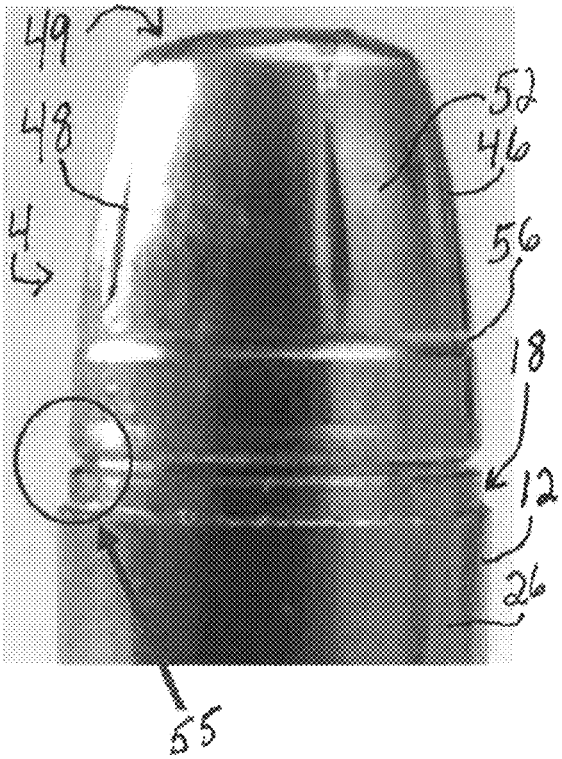
FIG. 7 is a partial front perspective view of a cartridge in accordance with an embodiment of the invention.
Figure 8:
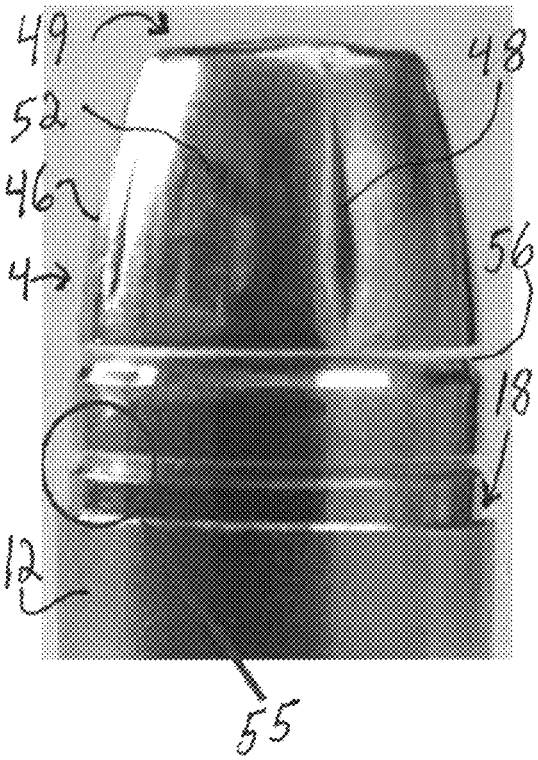
FIG. 8 is a partial front perspective view of a cartridge in accordance with an embodiment of the invention.

In embodiments, the sheer groove 55 may extend circumferentially around the bullet axis 11. In embodiments, the shear groove 55 may be formed by cutting into the jacket 38, for example, using a lathe. In an embodiment, the shear groove may be rolled in, for example, using a production capable cannelure blade. FIGS. 7 and 8 show examples of a cut groove 55 and rolled groove 55, respectfully. In an embodiment, the circumferential groove or shear groove 55 may be at a distance 65 of about 0.075 inches rearward from the forward circumferential indentation 56.

Figure 6:
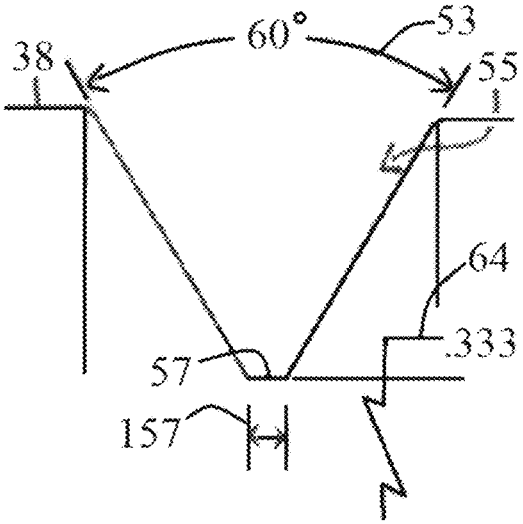
FIG. 6 is a partial side view of the bullet of FIG. 4.

In embodiments, the side profile of the shear groove 55 may form an acute angle 53, wherein the acute angle is radially oriented, as shown in FIG. 6. Distinct examples of the acute angle 53 include an acute angle of at least 20 degrees, an acute angle of at least 30 degrees, an acute angle of at least 40 degrees, an acute angle of at least 50 degrees and an acute angle of at least 60 degrees. In embodiments, as illustrated in FIG. 6, the shear groove 55 may form an angle of about 60 degrees.

In embodiments, the shear groove 55 may include a bottom flat 57 positioned radially outside the apex of the acute angle 53 and having an axial width 157. In an embodiment, the bottom flat 57 may measure about 0.004 inches. Distinct examples of the width include a width of at least 0.002 inches, a width of at least 0.003 inches, a width of at least 0.004 inches and a width of at least 0.006 inches.

In embodiments, the bullet 4 may have a diameter 64 measured at the bottom flat 57. In embodiments, diameter 64 is less than the diameter of the bullet 4 measured at an outer surface immediately adjacent point forward or rearward of the shear groove 55 and less than diameters at the bearing surfaces 143, 145. Distinct examples of the measurement of diameter 64 include a diameter 64 that measures less than or equal to 96% of the diameter of the bearing surface of the bullet 4, a diameter 64 that measures 91% to 96% of a diameter of a bearing surface of the bullet 4, a diameter 64 that measures 92% to 95% of a diameter of a bearing surface of the bullet 4, and a diameter 64 that measures 93% to 94% of a diameter of a bearing surface of the bullet 4. In an embodiment, the diameter 64 measures 93% to 94% of a diameter of a bearing surface of the bullet 4. In an embodiment, the diameter 45 at the bearing surfaces measures 0.3552+/−0.0003 inches and the diameter 64 measured at the bottom flat 57 measures about 0.333 inches, as illustrated in FIG. 6.

In embodiments, the shear groove 55 may be formed, such that the jacket material may be displaced axially and doesn't appreciably project radially into the core 39, as can be seen in FIG. 3. In embodiments, the thickness 62 of the jacket 38 between the bottom flat 57 and the core 39 may be less than the thickness 61 of the jacket or the average thickness of the jacket 38 along the length 146 of the bullet 4, excluding axial portions including circumferential indentations. In embodiments, the thickness 62 of the jacket 38 between the bottom flat 57 and the core 39 may be about half or less than the jacket 38 at an immediately adjacent point forward or rearward of the shear groove 55. Distinct examples of the thickness 62 of the jacket 38 between the bottom flat 57 and the core 39 include a thickness that is about three fourths or less than that of the jacket 38 at an immediately adjacent point forward or rearward of the shear groove 55, a thickness that is about two thirds or less than that of the jacket 38 at an immediately adjacent point forward or rearward of the shear groove 55 and a thickness that is about one third or less than that of the jacket 38 at an immediately adjacent point forward or rearward of the shear groove 55.

In embodiments, the forward circumferential indentation 56 may be a ring of reduced radial diameter of the bullet 4 relative to the outer surface of the jacket 38 immediately forward and rearward of the forward circumferential indentation 56. In embodiments, the forward circumferential indentation 56 may be axially positioned at or adjacent to the rearward end of elongated paths of weakening 48 formed in the ogive portion 46. The forward indentation 56 may extend into the jacket 38 and the jacket 38 thereby may project radially into the core 39. In embodiments, the forward circumferential indentation 56 may be axially position forward of the shear groove 55 in the ogive portion 46 of the bullet 4. In an embodiment, the forward circumferential indentation 56 may be at a distance 157 of about 0.230+/−0.005 inches rearward from the forward end of the bullet. The location of the hinge or circumferential indentation 56 may change with diameter and mass of the bullet 4. In embodiments, the location of the hinge or circumferential indentation 56 may be linked with pedal depth and positioned at or immediately adjacent to the rearward end of the paths of weakening or skives.

In embodiments, the forward circumferential indentation 56 may have a rounded profile, forming a circumferential channel having a bottom 66, which may be rounded, in the ogive portion 46 of the jacket 38.

In embodiments, the bullet 4 may have a diameter measured at the channel bottom 66 of the forward circumferential indentation 56. In embodiments, the diameter at the channel bottom 66 is less than the diameter of the bullet 4 measured at an outer surface at an immediately adjacent point forward or rearward of the forward circumferential indentation 56 and less than diameters at the bearing surfaces 143, 145. Distinct examples of the measurement of the diameter at the channel bottom 6 include a diameter that measures less than or equal to 96% of a diameter at a bearing surface of the bullet 4, a diameter that measures 91% to 96% of a diameter of a bearing surface of the bullet 4, a diameter that measures 92% to 95% of a diameter of a bearing surface of the bullet 4, and a diameter that measures 93% to 94% of a diameter of a bearing surface of the bullet 4. In an embodiment, the diameter measures 93% to 94% of a diameter of a bearing surface of the bullet 4. In an embodiment, the diameter at the bearing surfaces measures 0.3552+/−0.0003 inches and the diameter 64 measured at the channel bottom 66 measures about 0.333 inches.

In an embodiment, at the forward circumferential indentation 56, the thickness of the jacket 38 is not appreciably reduced relative to the thickness of the jacket 38 immediately forward and rearward of the forward circumferential indentation 56. In an embodiment, the forward circumferential indentation has a depth less than half the thickness of the jacket 38 at an immediately adjacent point. In some embodiments, the forward circumferential indentation has a depth less or equal to a third of the thickness of the jacket 38 at an immediately adjacent point.

In embodiments, the diameter 64 measured at the bottom flat 57 of the shear groove 55 may be about equal to the diameter measured at the channel bottom 66 of the forward circumferential indentation 56. In embodiments, the bottom flat 57 of the shear groove 55 may be radially aligned with the channel bottom 66 of the forward circumferential indentation 56.

In an embodiment, the forward circumferential indentation may be replaced with a circumferential path of weakening, as defined above, continuous or intermitting, around the jacket in the position of the forward circumferential indentation. The path of weakening may be partially or entirely through the thickness of the jacket, perpendicular or at an angle.

In embodiments, in application, when the bullet 4 is fired and impacts hard matter and upsets, the forward circumferential indentation acts as a hinge, folding normal expansion petals 52 back for accommodating deep penetration and high weight retention. In embodiments, the shear groove 55 has a different geometry and acts to release, separate or shear the petals in the event of bullet impact with hard surfaces, such as glass, causes the bullet 4 to over expand. This allows the remaining mass of the bullet to penetrate material after the hard material at a greater depth.

The rearward circumferential indentation 58 is shown in the figures as a ring of reduced radial diameter of the bullet 4 relative to the forward bearing surface 143 and/or the rearward bearing surface 145 of the body 44 of the bullet 4. In the areas of the rearward circumferential indentation 58, the thickness of the jacket 38 is not appreciably reduced relative to the thickness of the jacket 38 in the areas of the adjacent bearing surface(s) 143, 145 that are longitudinally adjacent to the rearward circumferential indentation 58. Portions of the core 39 radially aligned with the rearward circumferential indentation 58 are correspondingly reduced. The rearward circumferential indentation 58, indent into the core 39 in a gripping fashion, locking the base of the core 39 in the jacket 38. In embodiments, the rearward circumferential indentation 58 is axially positioned rearward of the shear groove 55. In some embodiments, the rearward circumferential indentation 58 is axially positioned rearward of the forward bearing surface 143 and in some embodiments forward of the rearward bearing surface 145.

In embodiments, the rearward circumferential indentation 58 may have a depth of at least 0.019 inches, and in some embodiments in the range of 0.019 inches to 0.0255 inches relative to an adjacent outer surface of the bullet 4. In various embodiments, the rearward circumferential indentation 58 may have a width measured axially. In some embodiments, the width may be in the range of about 0.038 inches to about 0.036 inches.

The rearward circumferential indentation 58 can form a knurling pattern 60 around the circumference of the bullet 4. The rearward circumferential indentation 58 can be a discreet bar knurl or applied as a single bar knurl in conjunction with a smooth or trench knurl, or combinations thereof. In some embodiments, the rearward circumferential indentation 58 can have a straight knurl frequency of 50 per inch.

In an embodiment, the bullet 4 may comprises no more or less than two circumferential indentations and one circumferential groove.

In embodiments, the forward 56 and/or rearward 58 circumferential indentations may form a continuous or intermitted circumferential ring.

FIGS. 4-6 illustrate an embodiment of the bullet 4 providing example specifications and technical data in accordance with an embodiment of the invention. In an embodiment as illustrated in such figures: dimensions are given in inches; the bullet weight can be about 147.0+−2.5 grs.; arrow 4 is as measured off-center to avoid hole in middle and excess lead is removed from nose before measuring; arrow 6 is diameter after cannelure. As seen in FIG. 5 the embodiment shown includes five circumferentially spaced petals 52 and core segments 54.

In embodiments, when the bullet 4 is inserted into a case 12 to form a cartridge 2 of the present invention, a span of bearing surface 43 engages an inner annular surface of the case wall 26. In embodiments of the cartridge 2 of the invention, the rearward circumferential indentation 58 is positioned rearward of the mouth 18 of the case 12. In at least some embodiments, the shear groove 55 is positioned forward of the mouth 18 of the case 12, as seen in FIG. 1A.

In an embodiment of the cartridge 2 of the invention, the leading edge 28 of the case 12 is not crimped or inset into the jacket 38. In embodiments, the leading edge 28 of the case 12 may be positioned rearward of the circumferential groove 55. The leading edge 28 of the case 12 may be positioned at or immediately adjacent to the transition portion 47.

In embodiments, in application and use, cartridges 2 may be sized for use in automatic and/or semi-automatic handguns and loaded and fired. Upon impact, the bullet 4 is upset and mushroomed, as seen in FIGS. 9 and 10. The bullet collapses and expands in response to the pressure created by the impact upon the weakening features. In this process, the petals 52 and segments 54 are unfurled rearward. FIGS. 9 and 10 illustrate the mushrooming of a mushrooming bullet and the unfurling of the petals 52 and segments 54. The upset bullet 4 forms a mushroomed head forward of the shear groove 55. The jacket 38 is separated along its elongated paths 48 and exposing the core segments 54, which similarly are separated along their elongated paths. Nonexclusive examples of this may be found in U.S. Pat. No. 6,805,057, which is incorporated herein by reference in its entirety.

In some application situations the bullet has to go through hard material, such as glass, before it penetrates the target soft material. In such situations, the hard material can cause the bullet to over expand, creating a larger front profile. This can slow the bullet down through target softer material, reducing the bullets penetration. In embodiments, the shear groove 55 of the bullets 4 herein counteracts the over expansion by allowing the expanding portion (petals 52 and core segments 54) of the bullet 4 to shear away, preventing over-expansion. If the bullet was deforming past a certain point, instead of it stopping the bullet short on penetration, the expanding forward portions of the bullet 4 can break away to allow the core of the bullet to still reach target penetration. In the above discuss FBI testing protocol, this means 12 inches into a gelatin block.

In embodiments, during upset of the bullet 4, the shear groove reduces forces that can cause separation of the jacket 38 from the core 39 initiated upon impact. The shear groove 55 may be positioned and formed to act as a stress riser, allowing tearing away or shearing of forward portions of the bullet 4 as the bullet encounters hard barriers, such as laminated auto-glass and the automobile glass in the Automobile Glass Test. The tearing away or shearing of forward portions of the bullet 4 allows the remaining jacketed rear portion of the bullet to penetrate the soft target to an acceptable depth. The intentional mechanical separation of petal 52 and segment 54 material and the rearward jacketed core 39 prevents the mechanical damage from propagating to the rear of the bullet 4, allowing it to remain fully intact ensuring adequate mechanical retention of the jacket 38 to the core 39 through difficult barriers.

In embodiments, the shear groove of the bullet causes the jacket to shear away from the bullet and thus prevent wings formed by expanding petals. With the shear groove feature, bullets have shown an average 25 point Improvement in FBI scores. Penetrations through Auto Glass are significantly improved with the number of glass rounds penetrating less than 12" being reduced significantly.

Testing was conducted comparing a sample group of bullets 4 as disclosed herein incorporating the shear groove 55, as shown in FIGS. 1 and 3, and a sample group of control bullets that did not include the shear groove, but otherwise were the same. The testing followed the FBI created a protocol for glass penetration. As part of this test and comparison, the penetration of each shot fired was measured. Generally, penetration of 12" into ballistics gelatin, even after traveling through the glass barrier, is the minimum desired penetration. In a FBI scoring test; anything penetrating less than that would have points deducted.

Figure 11:
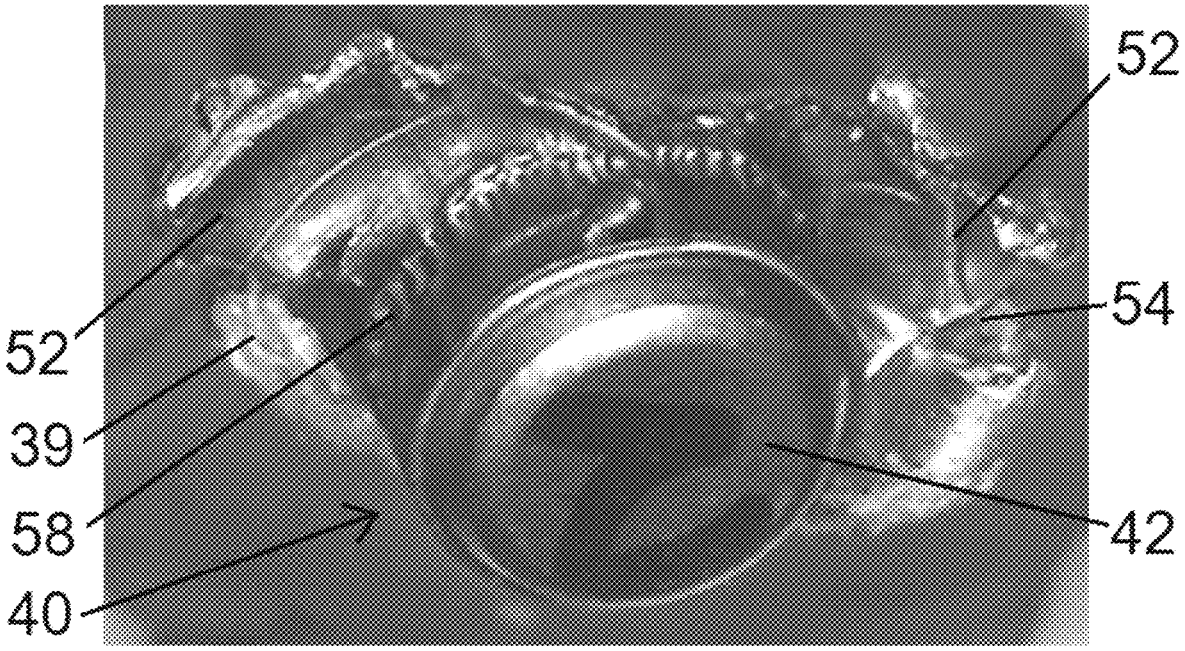
FIG. 11 is a side, bottom perspective view of an upset bullet in expanded condition after firing and impact.
Figure 12:
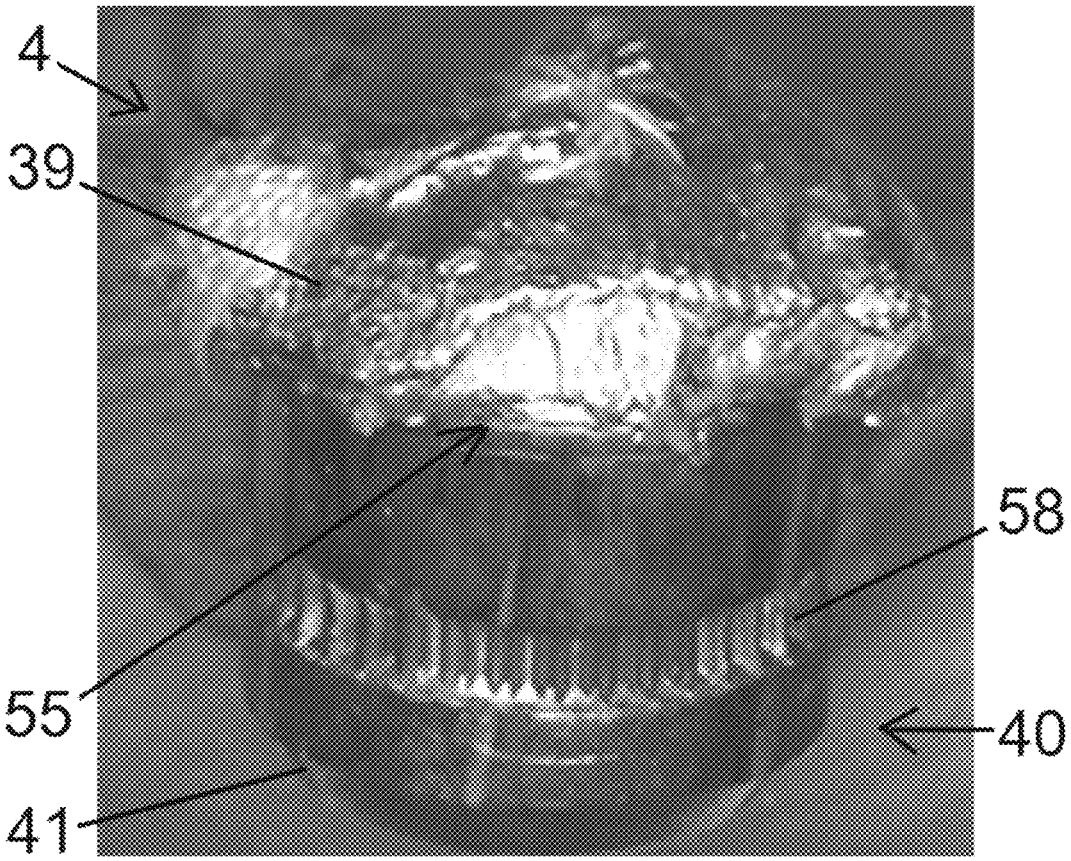
FIG. 12 is a side, top perspective view of a bullet in accordance with an embodiment of the invention after firing and impact.

FIGS. 11 and 12 illustrate a control bullet (FIG. 11) and a bullet 4 in accordance with the present invention (FIG. 12) after firing through the glass barrier and into the gelatin. As can be seen, the control bullet shown in FIG. 11 over-expanded all the way down to the rearward cannelure, creating a large front profile. In contrast, the shear groove bullet shown in FIG. 12 shed forward portions of the bullet and remained compact. The control bullet penetrated 9.5 inches, while the shear groove bullet penetrated 14 inches. The FBI protocol test is a difficult and destructive test of penetration after auto glass. The shear groove allowed the expanding portion of the bullets disclosed herein to shear away if over-expansion was occurring. If the bullet was deforming past a certain point, instead of it stopping the bullet short on penetration, it could break away to allow the core of the bullet to still reach the 12" minimum.

Figure 13:
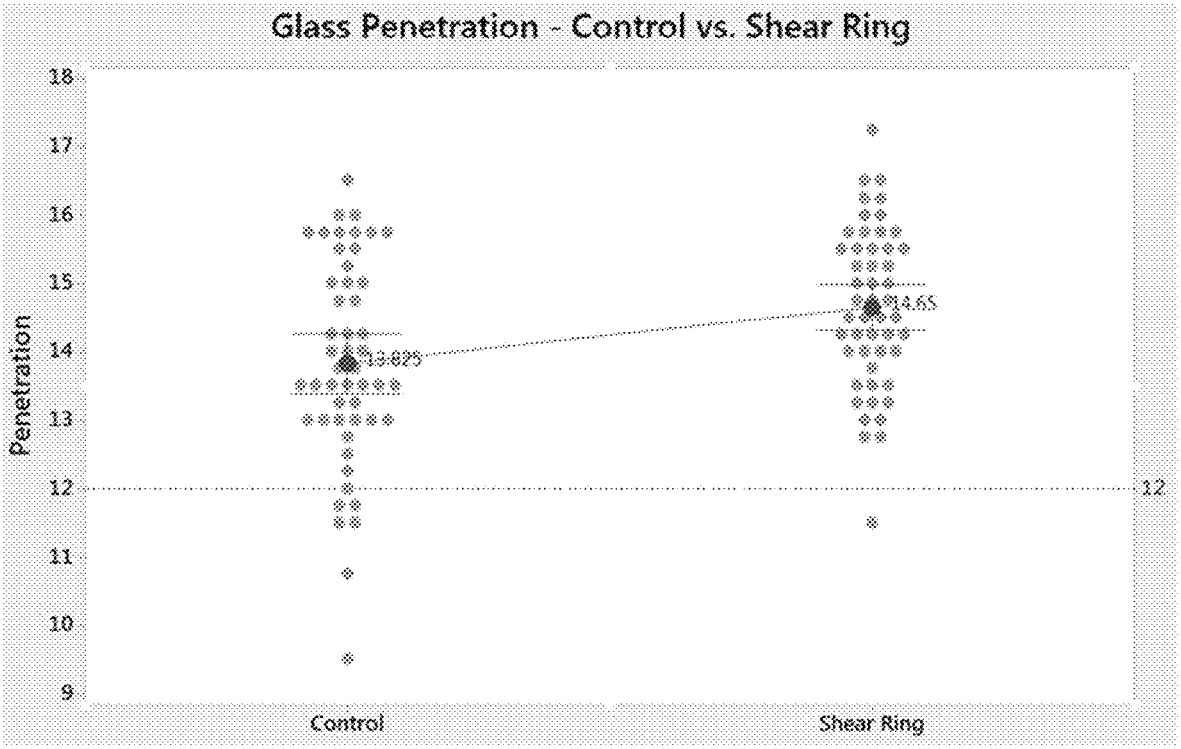
FIG. 13 is a graph showing Glass Penetration of Control and Bullet in accordance with an embodiment of the invention.
Figure 14:
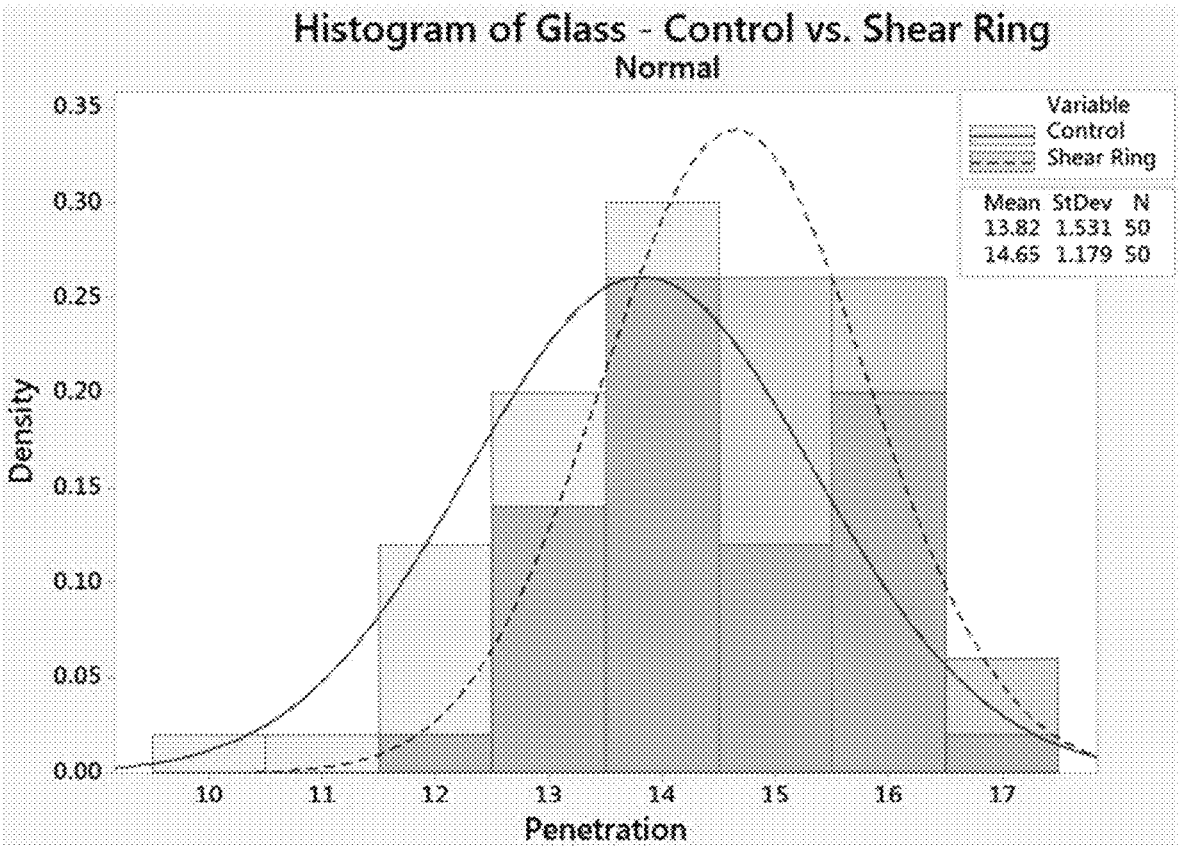
FIG. 14 is a graph showing a histogram of Glass Penetration of Control and Bullet in accordance with an embodiment of the invention.

Results of the testing are shown in FIGS. 13-14. The graph of FIG. 13 shows penetration values of the bullets after going through the glass. As can be seen, the bullets incorporating the shear groove exhibited greater penetration overall. The graph of FIG. 14 is a histogram graph of the results. The shear groove sample group showed greater and more consistent penetration. The mean was 14.65 inches with a standard deviation of 1.179 verses a mean of 13.82 inches with a standard deviation of 1.531 exhibited by the control group.

Figure 15:
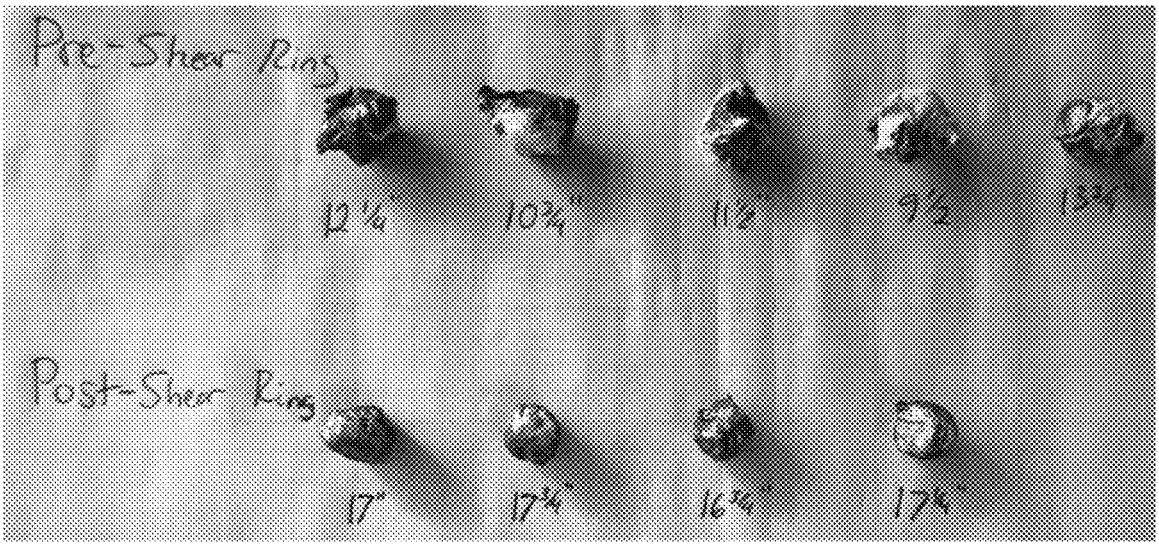
FIG. 15 is a photograph showing control bullets and bullets in accordance with an embodiment of the invention after glass penetration testing.

FIG. 15 illustrates further testing results. The top row show bullets fired without a shear groove 55 and the lower row shows resulting bullets with shear grooves. The penetration depths are shown below the bullets. As can be seen, the shear groove bullets exhibited superior performance. It is also clear to see that the shear groove bullets were compact and dense as compare to the control bullets, which were over-expanded with broad profiles.

The shear grooves 55 of the bullets shown were formed by lathe cutting. The testing resulted in significant improvement in the Auto Glass tests. Further testing resulted in a FBI protocol score of 380. Testing on bullets having shear grooves formed with production capable cannelure blade. Results from fifteen glass shots ranged from 12.75" to 16.25" (Ave of 14.27").

Three further FBI protocols were shot with scores of 460, 430 & 410. The following Table I shows results of 10 comparison shoots comparing shear groove bullets against a control group without shear grooves, showing further superior performance by the shear groove bullets.

TABLE I

Sample FBI Scores

| Sample No. | Control | Shear Ring |
|---|---|---|
| 1 | 375 | 435 |
| 2 | 395** | 425 |
| 3 | 425 | 435 |
| 4 | 360** | 430 |
| 5 | 415* | 430 |
| 6 | 415* | 460 |
| 7 | | 425 |
| 8 | | 400 |
| 9 | 425 | 430 |
| 10 | | 400* |
| Min: | 360 | 400 |
| Max: | 425 | 460 |
| Avg: | 401 | 427 |

*1 rnd under 12"
**2 rnds under 12"

In construction of embodiments of the invention, the bullet 4 may be formed via swaging or molding a blank of lead inside a cup shaped jacket blank. Inward radial pressure is then applied with to the outer body of the jacket to form the rearward circumferential indentations 58, securing the jacket 38 to the core 39. The tooling used may be designed to impart a knurling pattern around the body of the jacket 38. Before or after the jacketed blank of lead is cannelured, the forward end of the bullet is then constricted using a framing tool or the like to form the generally frustoconical front end portion. The forward cavity 50 and the paths of weakness may be formed prior to constricting the forward end.

The bullet 4 is thereafter inserted into the case mouth 18 of a suitably sized case 12 to form a cartridge 2. The method of forming the cartridge 2 with a full jacketed bullet in accordance with the invention includes forming a bullet 4 having an ogival front end portion, a rearward circumferential indentation, a shear groove and a forward circumferential indentation within the bullet body and a forwardly open cavity and inserting the bullet in a case.

In an aspect of the invention, the bullet may be made using a method which comprises the steps of:

a) drawing a sheet metal blank into a cup shaped jacket blank having a flat bottom and a generally uniform thickness wall;

b) forming a malleable metal core in the cup shaped jacket blank against the bottom by swaging or molding the core directly into the blank;

c) providing a plurality of paths of weakness through the jacket wall;

d) forming a cavity in the metal core at the open end of the cup shaped blank;

e) deforming the end of the blank into an ogival or tapering front end portion of the bullet 4;

f) imparting a rearward circumferential indentation into the body of the cup shaped jacket blank, such that jacket material is forced radially inward creating an internal circumferential indentation which extends into the bullet core;

g) imparting a forward circumferential indentation into the body of the cup shaped jacket blank, such that jacket material is forced radially inward creating an internal circumferential indentation which extends into the bullet core; and h) imparting a shear groove into the body of the cup shaped jacket blank forward of the rearward circumferential indentation and rearward of the forward circumferential indentation.

Steps may be accomplished by the process described in, but not limited to, U.S. Pat. No. 6,805,057. Said patent is incorporated by reference. Step d) may be accomplished after step e). Step e) may be performed with sequentially made circumferential indentation or simultaneously made circumferential indentations. Forming circumferential indentations, process steps and tooling is described in, but not limited to, U.S. Pat. No. 6,805,057. Said patent is incorporated by reference Additionally, after formation of the bullet, in embodiments of the invention, the following steps occur:

g) selecting a propellant to provide a kinetic energy;

h) partially filling a case 12 having a central primer with a quantity of propellant;

i) inserting the bullet into the partially filled case to form a cartridge;

j) repeating the above process forming multiple cartridges;

k) inserting the cartridges made above into a form with a rectangular footprint with a matrix of cartridge sized recesses in a form, forward end down, the form being sized for being received in a box; and l) installing the form filled with bullet cartridges in a box.

The bullet 4 may include a resiliently deformable plug or polymeric material inserted in the cavity 50 at the forward end 36 of the bullet 4.

Figure 16:
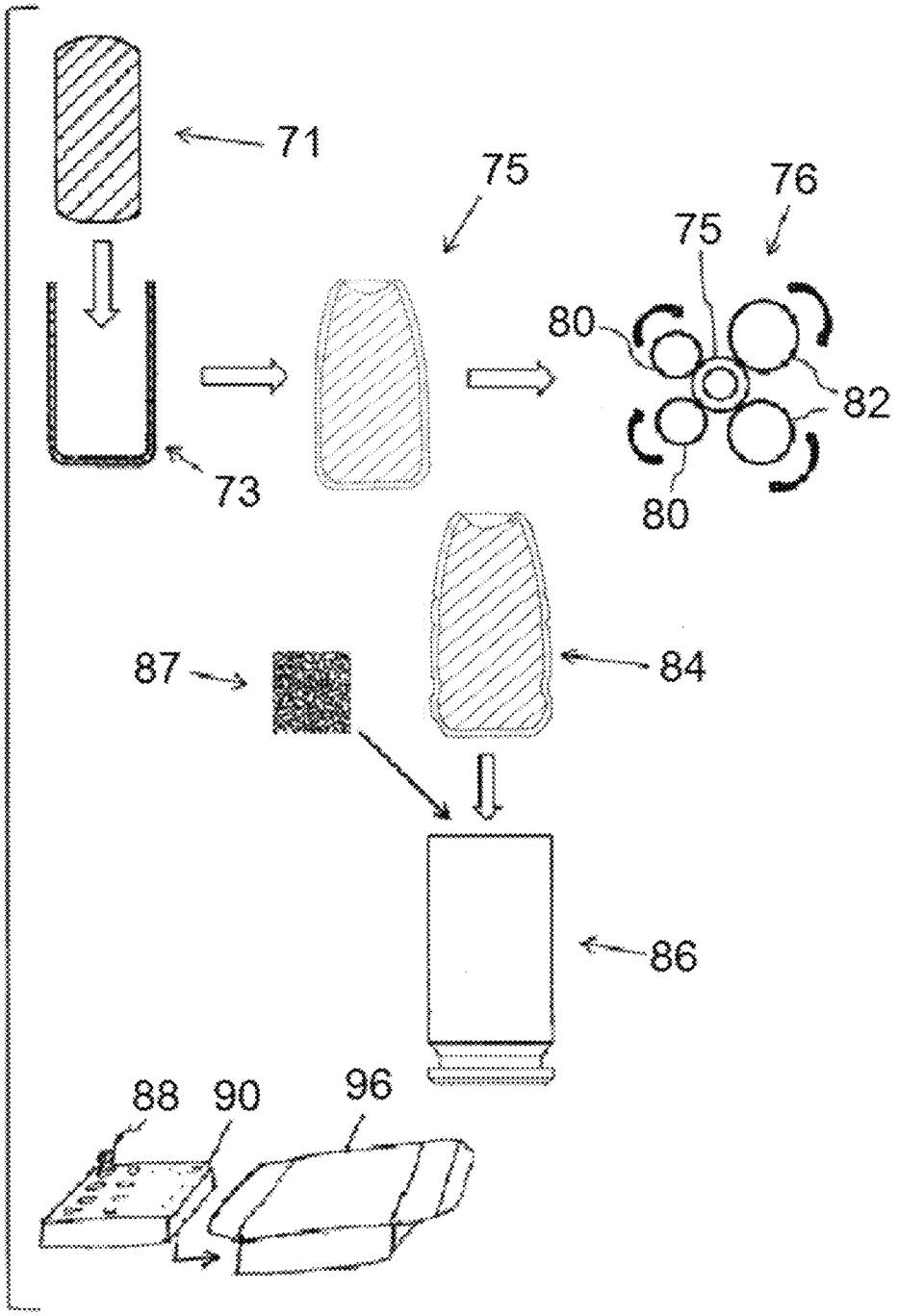
FIG. 16 is a diagram view of methodologies in accordance with an embodiment of the invention.

Referring to FIG. 16, exemplary steps in the formation of the cartridges are illustrated. In an embodiments, a blank 71 of lead or core material may be swaged or molded into a cup 73 of jacket material, for example, copper or copper alloy, forming a jacketed bullet 75. A rotating impressed wheel on bullet forming equipment 76 with rollers 80 and wheels 82 (shown in plan view) may be used to impart a shear groove 55 and forward 56 and rearward 58 circumferential indentations. The formed bullet 84 may be inserted into a case 86 with primer and propellant 87. Completed cartridges 88 may then be inserted into a packing form 90 with a matrix of cartridge recesses 92, which may be packaged in a box 96 Both the shear groove 55 and forward circumferential indentation 56 may be applied with a rotating impressed wheel on bullet forming equipment.

Different jacket 38 thicknesses and alloy compositions may be utilized and different numbers of paths 48 imparted in the jacket 38. In addition, the forward end cavity 50 may be differently shaped. Accordingly, it is intended to embrace all such variations and modifications as defined by the scope of the appended claims. In an embodiment, the jacket 38 may comprise plating having a thickness 61 of about 0.018 inches.

In some aspects of the invention, the bullet is a non-bonded bullet. For the aspects of invention, suitable materials for the jacket 38 include, but are not limited to, conventional jacket material, copper, aluminum, brass, tin, tungsten, zinc, iron, copper, aluminum and steel and alloys thereof and combinations thereof. The core 39 may be made principally of malleable materials suitable for bullet cores that exhibit upset, such as lead, lead alloys, tin, tin alloys, and combinations thereof. Other suitable materials may be found in the incorporated references listed below, which are incorporated herein by references in their entireties.

In some embodiments the, the length of the bullet is from about 0.580 inches to about 0.670 inches. In some embodiments, the length of the cartridge is about 1.135 inches to about 1.275 inches. In an aspect of the invention, an aspect ratio of the bullet length to the bullet diameter may be about 1.05 to about 2.00. In further aspects, the ratio may be about 1.35 to about 1.95. In an aspect of the invention, the ratio of the cartridge length to the bullet diameter may be about 2.30 to about 4.45. In further aspects, the ratio may be about 2.50 to about 3.30.

In some embodiments of the invention, the cartridge has a caliber of 9 mm and can have a ratio of bullet length to bullet diameter of about 1.60 to about 2.00. In some embodiments of the invention, the cartridge may be about a 40 caliber cartridge or a 10 mm caliber cartridge and have a ratio of bullet length to bullet diameter of about 1.45 to about 1.65. In some embodiments of the invention, the cartridge may be about a 45 caliber cartridge and have a ratio of bullet length to bullet diameter of about 1.35 to about 1.55.

General measurements, sizes and weights and ranges therefore for the cartridges, cases and bullets described herein shall include and be consistent with SAAMI/ANSI (Sporting Arms and Ammunition Manufacturing Institution, Inc./American National Standards Institute) standards and those standards described in the current *Voluntary Industry Performance Standards for Pressure and Velocity of Centerfire Pistol and Revolver Ammunition for the Use of Commercial Manufactures* by American National Standards Institute, all of which is incorporated herein by reference.

The cartridges of the present invention are directed to handgun projectiles, such as for law enforcement, government agency duty and civilian personnel defense use. The bullets of the present invention, including all of the aspects and embodiments, are adapted for mounting in a cartridge case for firing. The states of the cartridge and bullet aspects and embodiments described are unfired and pre-fired states and are undeformed and ready for conventional use.

In embodiments, cartridges disclosed include bullets for "handguns" of various calibers, in particular, semi-automatic and automatic pistols, including automatic colt pistols ("ACP"). The disclosure includes embodiments for cartridges and bullets designed for and capable of meeting current FBI standardized terminal performance test protocols and penetration requirements. Calibers originally related to inches can also use the term "caliber" in association with millimeters.

The designs and methods of the present invention are applicable to cartridges and handguns described below and/or having the following specifications.

| Cartridge | Bullet Length (70) (inches) | Bullet Diameter (72) (inches) | Cartridge (Bullet and Case combined) Length (74) (inches) |
|---|---|---|---|
| 9 mm 124 GR | .600 | .3555 | 1.169 |
| 9 mm 147 GR | .681 | .3555 | 1.169 |
| 40 S&W 165 GR | .601 | .4005 | 1.135 |
| 40 S&W 180 GR | .645 | .4005 | 1.135 |
| 45 AUTO 230 GR | .630 | .4513 | 1.275 |
| 357 SIG 125 GR | .585 | .3555 | 1.140 |
| 45 GAP 230 GR | .670 | .4513 | 1.137 |

Handgun projectiles further include 9 mm Luger with 100-160 gr projectiles; 40 S&W with 135-210 gr projectiles; 45 Auto (ACP) with 155-250 gr projectiles; 38 Special with 100-200 gr projectiles; 357 Magnum with 100-200 gr projectiles; 357 Sig with 100-160 gr projectiles; 45 G.A.P. with 155-250 gr projectiles; and 10 mm bullets, including 10 mm Auto with 135-210 gr projectiles.

Moreover, the propellant utilized in such handgun needs to be suitable for generating the pressures and velocities in the handgun suitable for sufficient penetration in the FBI protocol tests. A primary characteristic is the propellant burn rate. Certain propellants known in the art have established consistent burn rates when utilized in particular rounds. Propellants suitable for the invention herein have burn rates within or about within the range defined by St. Marks OBP 242 to St. Marks SMP 301.

One or more embodiments of the present invention have been described. Nevertheless, it will be understood that various modifications may be made without departing from the spirit and scope of the invention. For example, various different ogive and cavity shapes may be used as may be various different shapes and orientations. The dimensions given are merely exemplary and actual dimensions will be influenced by the particular caliber, desired bullet mass, and various form and performance considerations. Accordingly, other embodiments are within the scope of the following claims.

The above and below references, including US Patents and Patent Publications, in all sections of this application are herein incorporated by references in their entirety for all purposes, including to extent that they aid in materials, formulations, formulation methods and methods for making and using the compositions of the present invention.

REFERENCES

U.S. Pat. No. 682,600
U.S. Pat. No. 694,675
U.S. Pat. No. 1,077,564
U.S. Pat. No. 1,077,607
U.S. Pat. No. 1,080,976
U.S. Pat. No. 1,081,616
U.S. Pat. No. 1,730,871
U.S. Pat. No. 2,123,981
U.S. Pat. No. 2,333,091
U.S. Pat. No. 2,616,371
U.S. Pat. No. 2,792,618
U.S. Pat. No. 2,838,000
U.S. Pat. No. 3,142,256
U.S. Pat. No. 3,143,966
U.S. Pat. No. 3,157,137
U.S. Pat. No. 3,311,962
U.S. Pat. No. 3,349,711
U.S. Pat. No. 3,426,685
U.S. Pat. No. 4,193,348
U.S. Pat. No. 4,245,557
U.S. Pat. No. 4,336,756

-continued

| REFERENCES |
| --- |
| U.S. Pat. No. 4,550,662 |
| U.S. Pat. No. 4,610,061 |
| U.S. Pat. No. 4,836,110 |
| U.S. Pat. No. 4,856,160 |
| U.S. Pat. No. 4,882,822 |
| U.S. Pat. No. 4,947,755 |
| U.S. Pat. No. 5,079,814 |
| U.S. Pat. No. 5,101,732 |
| U.S. Pat. No. 5,208,424 |
| U.S. Pat. No. 5,259,320 |
| U.S. Pat. No. 5,275,108 |
| U.S. Pat. No. 5,357,866 |
| U.S. Pat. No. 5,385,100 |
| U.S. Pat. No. 5,544,398 |
| U.S. Pat. No. 5,811,723 |
| U.S. Pat. No. 5,943,749 |
| U.S. Pat. No. 6,178,890 |
| U.S. Pat. No. 6,182,574 |
| U.S. Pat. No. 6,244,187 |
| U.S. Pat. No. 6,305,292 |
| U.S. Pat. No. 6,530,328 |
| U.S. Pat. No. 6,732,657 |
| U.S. Pat. No. 6,776,101 |
| U.S. Pat. No. 6,805,057 |
| U.S. Pat. No. 6,935,243 |
| U.S. Pat. No. 7,143,679 |
| U.S. Pat. No. 7,162,942 |
| U.S. Pat. No. 7,207,275 |
| U.S. Pat. No. 7,814,837 |
| U.S. Pat. No. 8,256,352 |
| U.S. Pat. No. 8,276,494 |
| U.S. Pat. No. 8,413,587 |
| U.S. Pat. No. 8,646,389 |
| U.S. Pat. No. 8,950,333 |
| U.S. Pub. 20080216700 |
| U.S. Pub. 20100018430 |
| U.S. Pub. 20130025490 |
| U.S. Pub. 20140230683 |
| U.S. Pub. 20150083011 |
| EP Pat. 2551630 |
| RU Pat. 2180427 |
| WO Pub. 2013086544 |

For purposes of interpreting the claims for the present invention, it is expressly intended that the provisions of Section 112, sixth paragraph, of 35 U.S.C. are not to be invoked unless the specific terms "means for" or "step for" are recited in a claim.

When "about" is used herein associated with a specific parameter and is not otherwise defined, it is hereby defined to mean within 10% of the stated quantity of the parameter.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A rimless cartridge for firing in a handgun, the rimless cartridge comprising:

a case comprising a forward cylindrical wall connecting to a rearward head having a neck and an annular flange, the forward cylindrical wall defining an interior cavity and terminating at a leading edge defining a an opening and the rearward head having an outermost diameter no greater than that of the forward cylindrical wall;

propellant in the internal cavity of the case; and a bullet inserted into the opening of the case and comprising a core and a jacket of metallic material at least partially enveloping the core, the bullet having a rearward cylindrical body portion and a forward tapered portion, a forward cavity and a plurality of skives defining a plurality of expansion petals in the jacket, each skive being axially oriented and having a forward end and a rearward end, the bullet having a rearward circumferential indentation formed in the rearward cylindrical body portion, and a circumferential groove formed in the tapered portion and positioned axially forward of the rearward circumferential indentation, wherein, upon firing and impact with hard material, the expansion petals are configured to fold back, and the circumferential groove is configured to act to release the plurality of expansion petals if the impact with the hard surface results in over-expansion.

2. The rimless cartridge of claim 1, wherein the circumferential groove extends into the jacket, forming an outwardly opening acute angle.

3. The rimless cartridge of claim 2, wherein the acute angle is about 60 degrees.

4. The rimless cartridge of claim 2, further comprising a forward circumferential indentation formed in the tapered portion and axially positioned at or adjacent to the rearward end of at least one of the plurality of skives and positioned axially forward of the circumferential groove, wherein the forward circumferential indentation forms a circumferential channel having a rounded bottom.

5. The rimless cartridge of claim 2, the circumferential groove having a bottom portion at an innermost portion of the circumferential groove, the bottom portion being substantially flat.

6. The rimless cartridge of claim 1, further comprising a forward circumferential indentation formed in the tapered portion and axially positioned at or adjacent to the rearward end of at least one of the plurality of skives and positioned axially forward of the circumferential groove, wherein the forward circumferential indentation defines a first diameter of the bullet and the circumferential groove defines a second diameter, the first and second diameters being substantially equal.

7. The rimless cartridge of claim 1, the bullet having radial segments formed in the core and the plurality skives defining a plurality of petals, wherein the plurality of radial segments are radially aligned with the plurality of petals.

8. The rimless cartridge of claim 1, wherein the circumferential groove is a cut-in cannelure, a formed groove, wherein material is removed in forming the groove, or a rolled-in groove, wherein the groove is formed without removing material.

9. The rimless cartridge of claim 1, further comprising a forward circumferential indentation formed in the tapered portion and axially positioned at or adjacent to the rearward end of at least one of the plurality of skives and positioned axially forward of the circumferential groove, wherein a cross section of the bullet at the forward circumferential indentation has a diameter of about 0.333 inches.

10. The rimless cartridge of claim 1, wherein a cross section of the bullet at the circumferential groove has a diameter of about 0.333 inches.

11. The rimless cartridge of claim 1, wherein the bullet is a caliber chosen from the group consisting of 9 mm caliber, 10 mm caliber, 40 caliber and 45 caliber.

12. The rimless cartridge of claim 1, wherein the bullet is a 9 mm caliber bullet.

13. A method of making a rimless cartridge sized and adapted to be used in a handgun comprising the steps of:

a) drawing a sheet metal blank into a cup shaped jacket blank having a flat bottom and a generally uniform thickness wall;

b) forming a malleable metal core in the cup shaped jacket blank against the bottom by swaging or molding the core directly into the blank;

c) providing a plurality of axially oriented skives through the jacket wall, each skive having a forward end and a rearward end;

d) forming a cavity in the metal core at the open end of the cup shaped blank;

e) deforming the end of the blank into an ogival or tapering front end portion of the bullet, wherein in the plurality of skives are formed in the tapering front end portion;

f) imparting a rearward circumferential indentation into the body of the cup shaped jacket blank, such that jacket material is forced radially inward creating an internal circumferential indentation which extends into the bullet core; and g) imparting a circumferential groove into the body of the cup shaped jacket blank forward of the rearward circumferential indentation, wherein the circumferential groove is formed in the tapering front end portion, wherein, upon firing and impact of the bullet with a hard surface, the circumferential groove effectuates a shearing of normal expansion petals formed as a result of over-expansion after the impact with the hard surface.

14. The method of claim 13, wherein the circumferential groove extends into the jacket, forming an outwardly opening acute angle.

15. The method of claim 14, wherein the acute angle is about 60 degrees.

16. The method of claim 13, further comprising the step of:

h) imparting a forward circumferential indentation into the body of the cup shaped jacket blank, wherein the forward circumferential indentation is formed in the tapering front end portion, wherein the circumferential groove is rearward of the forward circumferential indentation, and wherein the forward circumferential indentation is axially positioned at or adjacent to the rearward end of at least one of the plurality of skives, and wherein the forward circumferential indentations forms a circumferential channel having a rounded bottom.

17. The method of claim 14, the circumferential groove having a bottom portion at an innermost portion of the circumferential groove, the bottom portion being substantially flat.

18. The method of claim 16, wherein the forward circumferential indentation defines a first diameter of the bullet and the circumferential groove defines a second diameter, the first and second diameters being substantially equal.

* * * * *